US005793333A

United States Patent [19]

Taniguchi et al.

[11] Patent Number: 5,793,333

[45] Date of Patent: Aug. 11, 1998

[54] GLASS ANTENNA FOR VEHICLES, AND DESIGNING METHOD OF THE SAME

[75] Inventors: Tatsuaki Taniguchi, Hiroshima-ken; Shigeyuki Satomura, Hiroshima; Kazuo Shigeta, Hiroshima-ken; Kenji Kubota, Kure, all of Japan

[73] Assignee: Mazda Motor Corporation, Hiroshima-ken, Japan

[21] Appl. No.: 617,593

[22] Filed: Mar. 19, 1996

[30] Foreign Application Priority Data

Mar. 22, 1995 [JP] Japan ..... 7-062667
Mar. 22, 1995 [JP] Japan ..... 7-062668

[51] Int. Cl.[6] ..... H01Q 1/32

[52] U.S. Cl. ..... 343/713; 343/711

[58] Field of Search ..... 343/713, 711, 343/712, 704; H01Q 1/32

[56] References Cited

U.S. PATENT DOCUMENTS

| | | | |
|---|---|---|---|
| 3,766,563 | 10/1973 | Sauer et al. | 343/713 |
| 3,771,159 | 11/1973 | Kawaguchi et al. | 343/713 |
| 3,971,030 | 7/1976 | Sauer | 343/713 |
| 4,072,953 | 2/1978 | Comastri et al. | 343/713 |
| 4,090,202 | 5/1978 | Comastri et al. | 343/713 |
| 4,527,164 | 7/1985 | Cestaro et al. | 343/713 |
| 4,727,377 | 2/1988 | Yotsuya et al. | 343/713 |
| 4,749,998 | 6/1988 | Yotsuya | 343/713 |
| 4,823,142 | 4/1989 | Ohe et al. | 343/713 |
| 4,967,202 | 10/1990 | Shinnai et al. | 343/713 |
| 5,101,212 | 3/1992 | Shinnai et al. | 343/713 |
| 5,313,217 | 5/1994 | Kakizawa | 343/713 |

FOREIGN PATENT DOCUMENTS

| | | |
|---|---|---|
| 1-292902 | 11/1989 | Japan . |
| 4-77005 | 3/1992 | Japan . |

OTHER PUBLICATIONS

European Search Report, Mar. 11, 1997.

*Primary Examiner*—Hoanganh T. Le

[57] ABSTRACT

A vehicle glass antenna for receiving FM and AM radio waves, includes a first antenna line which vertically extends on a glass of the vehicle so as to receive the FM radio waves, and has a feeding point on the edge of the glass, and a second antenna line which is connected to the first antenna line at a position in the neighborhood of the feeding point so as to receive the radio waves in the AM band, and extends by a predetermined length in a loop pattern along the edge of the glass.

15 Claims, 35 Drawing Sheets

REFERENCE 0dB

3dB UP 1.9dB UP 2.2dB UP 1.5dB UP $\ell = 20$ cm

MARKER 1
76.0 MHz
1.7031 Ω
− 118.96 Ω
MARKER 2
80.0 MHz
1.0195 Ω
− 108.27 Ω
MARKER 3
89.92 MHz
1.9297 Ω
− 86.418 Ω
MARKER 4
100.0 MHz
2.1641 Ω
− 68.68 Ω
▶ MARKER 5
1.08.0 MHz
3.1621 Ω
− 55.145 Ω

$\ell = 40$ cm

MARKER 1
76.0 MHz
2.2012 Ω
− 55.549 Ω
MARKER 2
80.0 MHz
2.0215 Ω
− 45.016 Ω
MARKER 3
89.92 MHz
3.7549 Ω
− 19.76 Ω
MARKER 4
100.0 MHz
5.5039 Ω
5.2278 Ω
▶ MARKER 5
1.08.0 MHz
11.205 Ω
32.803 Ω

$\ell = 60$ cm

MARKER 1
76.0 MHz
3.5708 Ω
12.612 Ω
MARKER 2
80.0 MHz
4.1338 Ω
30.645 Ω
MARKER 3
89.92 MHz
11.684 Ω
91.871 Ω
MARKER 4
100.0 MHz
34.742 Ω
218.45 Ω
▶ MARKER 5
1.08.0 MHz
310.69 Ω
644.09 Ω

$\ell = 80$ cm

MARKER 1
76.0 MHz
11.07 Ω
146..25 Ω
MARKER 2
80.0 MHz
16.477 Ω
218.73 Ω
MARKER 3
89.92 MHz
716.31 Ω
1.1381 Ω
MARKER 4
100.0 MHz
47.928 Ω
− 461.89 Ω
▶ MARKER 5
1.08.0 MHz
12.063 Ω
− 237.98 Ω

$\ell = 100$ cm

MARKER 1
76.0 MHz
777.12 Ω
1.7965 KΩ
MARKER 2
80.0 MHz
280.62 Ω
− 1.2909 KΩ
MARKER 3
89.92 MHz
20.813 Ω
− 281.56 Ω
MARKER 4
100.0 MHz
05.352 Ω
− 158.52 Ω
▶ MARKER 5
1.08.0 MHz
4.0898 Ω
− 109.83 Ω

$\ell = 120$ cm

MARKER 1
76.0 MHz
24.75 Ω
− 383.14 Ω
MARKER 2
80.0 MHz
10.531 Ω
− 267.77 Ω
MARKER 3
89.92 MHz
07.125 Ω
− 141.39 Ω
MARKER 4
100.0 MHz
4.3828 Ω
− 83.684 Ω
▶ MARKER 5
1.08.0 MHz
6.6289 Ω
− 45.135 Ω

$\ell = 140$ cm

MARKER 1
76.0 MHz
08.195 Ω
− 188.3 Ω
MARKER 2
80.0 MHz
05.211 Ω
− 143.63 Ω
MARKER 3
89.92 MHz
5.582 Ω
− 74.184 Ω
MARKER 4
100.0 MHz
7.9434 Ω
− 16.508 Ω
▶ MARKER 5
1.08.0 MHz
22.996 Ω
57.385 Ω

$\ell = 160$ cm

MARKER 1
76.0 MHz
6.1602 Ω
− 115.25 Ω
MARKER 2
80.0 MHz
5.0273 Ω
− 83.277 Ω
MARKER 3
89.92 MHz
8.4263 Ω
− 11.04 Ω
MARKER 4
100.0 MHz
29.859 Ω
124.43 Ω
▶ MARKER 5
1.08.0 MHz
1.2294 KΩ
− 171.31 Ω

$\ell = 180$ cm

MARKER 1
76.0 MHz
6.0762 Ω
− 53.937 Ω
MARKER 2
80.0 MHz
6.9063 Ω
− 18.804 Ω
MARKER 3
89.92 MHz
30.766 Ω
134.22 Ω
MARKER 4
100.0 MHz
186.47 Ω
− 594.94 Ω
▶ MARKER 5
1.08.0 MHz
15.445 Ω
− 183.47 Ω

$\ell = 200$ cm

MARKER 1
76.0 MHz
10.973 Ω
29.393 Ω
MARKER 2
80.0 MHz
20.203 Ω
106.5 Ω
MARKER 3
89.92 MHz
385.31 Ω
− 625.16 Ω
MARKER 4
100.0 MHz
14.641 Ω
− 167.23 Ω
▶ MARKER 5
1.08.0 MHz
9.6133 Ω
− 87.992 Ω

$\ell = 220$ cm

MARKER 1
76.0 MHz
67.266 Ω
277.27 Ω
MARKER 2
80.0 MHz
1.5956 KΩ
936.56 Ω
MARKER 3
89.92 MHz
30.703 Ω
− 193.96 Ω
MARKER 4
100.0 MHz
9.7422 Ω
− 88.711 Ω
▶ MARKER 5
1.08.0 MHz
14.633 Ω
− 23.526 Ω

$\ell = 235$ cm

MARKER 1
76.0 MHz
2.1196 KΩ
151.63 Ω
MARKER 2
80.0 MHz
77.172 Ω
− 464.48 Ω
MARKER 3
89.92 MHz
19.266 Ω
− 132.91 Ω
MARKER 4
100.0 MHz
11.334 Ω
− 50.369 Ω
▶ MARKER 5
1.08.0 MHz
33.102 Ω
51.828 Ω

MARKER 1
76.0 MHz
21.755 Ω
− 16.338 Ω

MARKER 2
80.0 MHz
15.278 Ω
22.648 Ω

MARKER 3
89.92 MHz
152.55 Ω
90.82 Ω

MARKER 4
100.0 MHz
49.963 Ω
14.621 Ω

▶ MARKER 5
1.08.0 MHz
23.293 Ω
112.41 Ω

FIG. 57

| | | LEVEL OF DETUNED NOISE RECEIVED FROM HARNESS | RECEPTION SENSITIVITY OF AM ANTENNA |
|---|---|---|---|
| PRIOR ART 1 | WHEN AM ANTENNA WITH NORMAL SENSITIVITY IS SEPARATED FROM HARNESS | 6dB (OK) | 12dB |
| PRIOR ART 2 | WHEN AM ANTENNA WITH NORMAL SENSITIVITY IS ARRANGED NEAR HARNESS | 12dB | 12dB |
| SECOND EMBODIMENT | WHEN LOW-SENSITIVITY AM ANTENNA (-5dB) IS ARRANGED NEAR HARNESS | 7dB | 7dB |
| | WHEN LOW-SENSITIVITY AM ANTENNA (-8dB) IS SEPARATED FROM HARNESS | ABOUT 0dB | 4dB |
| | | COMBINATION 7dB (ALLOWABLE) | COMBINATION 11dB (ALLOWABLE) |
| PRIOR ART 3 | PILLAR ANTENNA | 6dB | 12dB |

GLASS ANTENNA FOR VEHICLES, AND DESIGNING METHOD OF THE SAME

BACKGROUND OF THE INVENTION

1. Field of the Invention

The present invention relates to a glass antenna for a vehicle such as a van having a rear glass with a special shape, and its design method.

2. Description of the Related Art

In general, a pole antenna, in which a pole (rod) protrudes on a vehicle body in an insulated state and is fed, is widely known as an antenna for a vehicle. However, the pole antenna easily causes breaking of the pole and disconnection of a line, and generates wind noise during traveling. For this reason, in place of the pole antenna, a glass antenna has been put into practical use. The glass antenna is normally arranged on a rear window glass in consideration of the outer appearance.

However, it is often difficult for vans, so-called hatchback vehicles, or the like to assure a wide space in a rear glass for the rear glass antenna. Since the rear door is usually opened and closed, power-feeding lines for the rear glass antenna must be flexible, resulting in an increase in cost.

Where an antenna is arranged on a window glass with a small space, for example, the following problems are posed:

(1): if the antenna is for an FM range, a required antenna length cannot be assured;

(2): if the antenna is for an FM range, a large impedance cannot be assured;

(3): if the antenna is for an AM range, the reception sensitivity lowers; and (4): since the antenna must be arranged in the neighborhood of the vehicle harness, it is easily influenced by noise from the harness.

Where antenna sensitivity is low, signal level may be increased by providing an amplifier. However, it is nonsense to add the amplifier since it also amplifies noise components.

In order to increase or adjust reception sensitivity, various proposals have been conventionally made.

For example, in Japanese Patent Laid-Open No. 4-77005, antenna conductors are arranged on two opposing side window glasses, and the reception outputs from these antennas are synthesized to increase the reception sensitivity. However, this method, in which a signal line for synthesizing the outputs from the two antenna conductors arranged on the two glass surfaces functions as another antenna conductor, cannot often provide a required target performance.

In view of this problem, in Japanese Patent Laid-Open No. 4-77005, arranged are a coil for filtering broad-band components and a phase adjustment conductor element. Such coil and phase adjustment element lead to an increase in cost.

On the other hand, Japanese Patent Laid-Open No. 1-292902 proposed a glass antenna comprising a primary antenna which extends perpendicularly downward from the central portion of the upper side of a window glass and has a feeding point, and an impedance adjustment antenna which is connected to a main antenna portion in the vicinity of the feeding point.

In the above-mentioned two prior arts devices another element is attached to a glass antenna, and such element causes an increase in cost.

In Japanese Patent Laid-Open No. 1-292902, the impedance adjustment antenna serves solely for the purpose of impedance adjustment, and does not directly contribute to improve the reception sensitivity.

SUMMARY OF THE INVENTION

The present invention has been made in consideration of the above situation, and has as its object to provide a high-performance vehicle glass antenna, which can omit parts that do not directly contribute to improvement in reception sensitivity.

It is another object of the present invention to provide a vehicle antenna which can realize a high-performance frequency diversity system by combining antenna lines arranged on two glass surfaces of a vehicle.

It is still another object of the present invention to provide a method of easily designing a high-performance frequency diversity antenna system.

In order to achieve the above objects, according to the present invention, there is provided a vehicle glass antenna for receiving a radio wave in a first frequency band and a radio wave in a second frequency band lower than the first frequency band, characterized by comprising:

a first antenna line (20, 20-1, 20-2) which extends on a first glass (10L) of the vehicle to receive the radio wave in the first frequency band and has an effective feeding point (16) arranged on the first glass; and a second antenna line (30, 30-1, 30-2) which is connected to said first antenna line to receive the radio wave in the second frequency band, and extends by a predetermined length along an edge of the first glass.

With this arrangement, the second antenna line serves as both an antenna line for receiving radio waves of the second frequency and a stub for the first antenna line. The stub structure can eliminate the influence of an AM reception antenna line on FM reception, and can consequently provide a high-performance glass antenna system. Also, a coil and an adjustment antenna line which are required in the conventional antenna can be omitted.

In order to achieve the above objects, according to the present invention, there is provided a glass antenna further comprising:

a third antenna line (31) which extends on a second glass (10R) different from the first glass to receive the radio wave in the second frequency band; and a connection line (14) for connecting said second and third antenna lines, one end portion of said connection line being connected to said third antenna line at a predetermined first connection position on the second glass, and the other end portion thereof being connected to said second antenna line at a predetermined second connection position, separated from the feeding point, on the first glass.

According to the glass antenna with the above arrangement, the second antenna line serves as both an antenna line for receiving radio waves of the second frequency and a stub for the first antenna line. The third antenna line is connected to the feeding point via the connection line and the second antenna line. The stub structure and the series connection structure of the second and third antenna lines can eliminate the influence of an AM reception antenna line on FM reception, and can consequently provide a high-performance frequency diversity antenna system.

In order to achieve the above objects, the present invention provides a method of designing antenna lines on first and second glass surfaces so as to receive a radio wave in a first frequency band and a radio wave in a second frequency band lower than the first frequency band, comprising the steps of:

determining a position of a feeding point and a length of a first antenna line, which extends substantially vertically on the first glass surface and receives the radio wave in the first frequency band;

determining a length and a terminal end position of a second antenna line, which extends from the position of the feeding point along an upper edge of the first glass surface; and determining a length of a third antenna line, which extends on the second glass surface and is electrically connected to the second antenna line via a connection line inserted from the terminal end position of the second antenna line, so that an impedance between the second and third antenna lines exhibits a high value in the first frequency band.

With this design method, a designer can easily design an antenna regardless of the mutual influence between the first antenna line, and the second and third antenna lines. More specifically, by combining antenna lines arranged on two glass surfaces of a vehicle, the stub arrangement and series connection can be easily realized. Therefore, since the designer need not consider the influence of other frequency bands, he or she can easily design a high-performance glass antenna system.

According to a preferred aspect of the present invention, the first frequency band is an FM frequency band, and the second frequency band is an AM frequency band.

According to a preferred aspect of the present invention, the first antenna line extends downward from substantially the central position, in the widthwise direction, of the first glass surface. The first antenna line, which receives radio waves of high frequencies preferably extends at a position which is not the edge of a glass.

According to a preferred aspect of the present invention, the second antenna line is not closed since it extends along the edge of the first glass surface and has an isolated terminal end point.

According to a preferred aspect of the present invention, the second antenna line extends along the edge of the first glass surface and has an additional line at intermediate position alongthere. Thus, a blank region of the glass surface can be positively utilized.

According to a preferred aspect of the present invention, the third antenna line has an additional line which extends along an upper edge of the second glass substantially horizontally, and at least two additional lines which extend along an edge of the second glass substantially vertically. Since the antenna has only one additional line that runs in the horizontal direction, the influence of harness noise can be eliminated.

According to a preferred aspect of the present invention, the first and second glasses have a substantially rectangular shape, the second antenna line has an additional line which extends along a lower edge of the first glass substantially horizontally, the third antenna line has an additional line which extends along an edge of the second glass in a substantially vertical direction, and the distance from the lower end portion of the second glass to the additional line of the third antenna line is set to be larger than the distance from the lower end portion of the first glass to the additional line of the second antenna line.

In this glass antenna, since the antenna line on the second glass is separated away from the harness, the influence of harness noise can be eliminated.

Other features and advantages of the present invention will be apparent from the following description taken in conjunction with the accompanying drawings, in which like reference characters designate the same or similar parts throughout the figures thereof.

BRIEF DESCRIPTION OF THE DRAWINGS

FIG. 57 is a table for explaining the noise reduction results in the second embodiment.

DETAILED DESCRIPTION OF THE INVENTION

Two preferred embodiments of the present invention will be described below with reference to the accompanying drawings. Glass antennas of the two embodiments are common in that they are applied to van type vehicles, and receive FM and AM radio waves with high sensitivity. In the first embodiment, FM and AM glass antennas are arranged on one of side window glasses of a vehicle. In the second embodiment, FM and AM glass antennas are arranged on one of side window glasses of a vehicle, and an additional AM antenna is arranged on the other side window glass. Since side window glasses (also a rear glass) of the vehicle stand upright, a large length cannot be assured in the vertical direction as compared to a front glass. The two embodiments can solve this problem posed when the glass antenna is arranged on the side window glass.

<First Embodiment>

Arrangement

Figure 1:
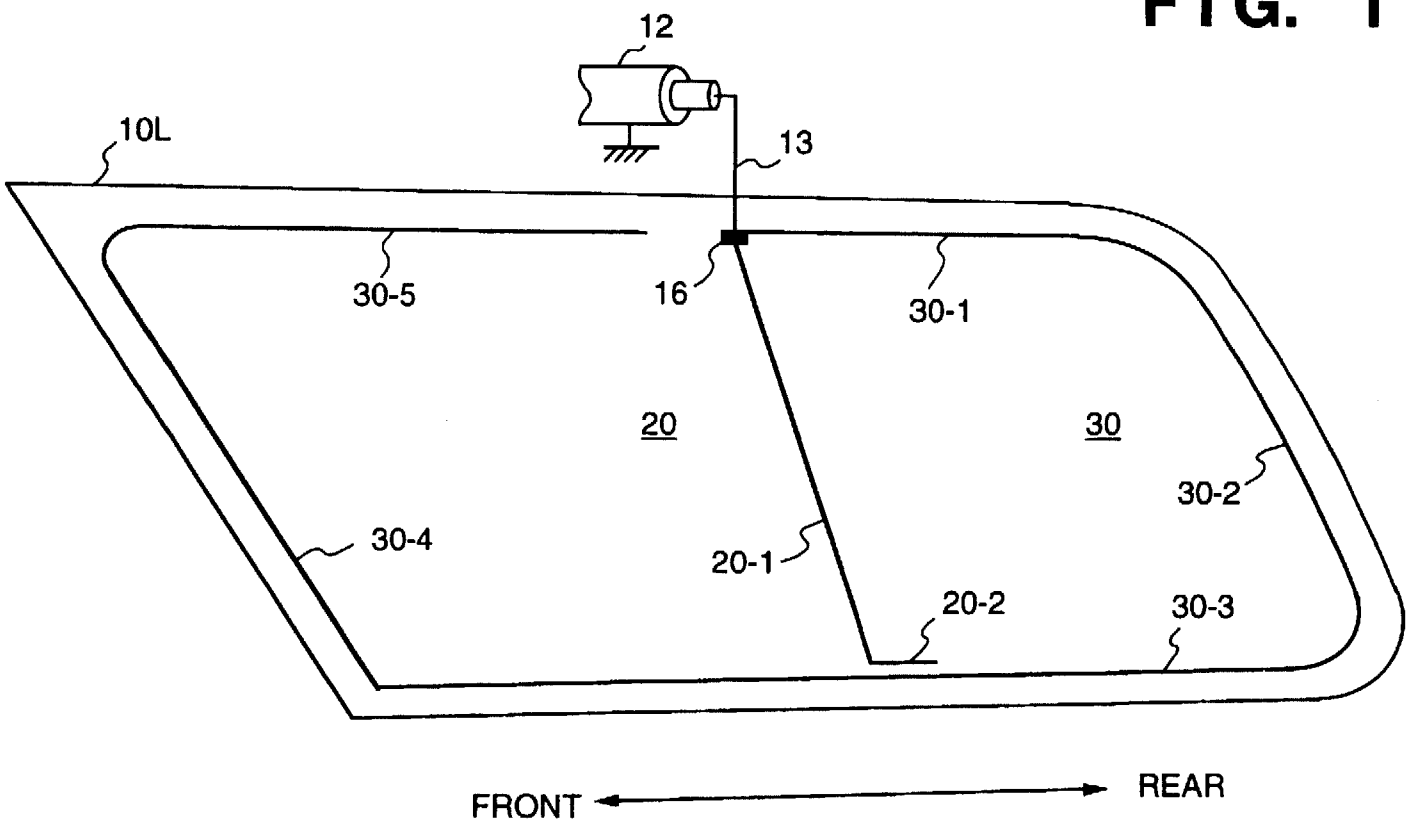
FIG. 1 is a view showing the arrangement of an antenna system according to the first embodiment of the present invention.

FIG. 1 explains the embodiment in which a glass antenna of the present invention is applied to the left side window glass of a vehicle. FIG. 1 shows the left side window glass when viewed from the outer side.

Referring to FIG. 1, reference numeral 10L denotes a left side window glass of a vehicle (illustration of a vehicle body itself is omitted). Note that the right direction in FIG. 1 corresponds to the rear portion of the vehicle body, and the left side corresponds to the front portion of the vehicle body. A glass on the right side of a passenger who faces forward is a right side window glass (10R; not shown in FIG. 1), and a glass on the left side thereof is the left side window glass (10L).

Referring to FIG. 1, reference numeral 20 (20-1, 20-2) denotes an antenna line for mainly receiving FM radio waves; 20-1, a primary antenna line; and 20-2, an additional portion which is added to adjust the length of the antenna line 20 for the purpose of improving the reception sensitivity of radio waves in the FM frequency band. In this embodiment, the antenna line 20 is a so-called monopole type antenna, and extends downward from a feeding point 16, as shown in FIG. 1. The reason why the additional antenna line 20-2 is bent from the primary antenna line 20-1 is that the length required for the antenna line 20 exceeds the vertical dimension of the glass 10L in FIG. 1.

In FIG. 1, the feeding point 16 is connected to a signal line 13, which is included in a coaxial cable 12. The cable 12 is connected to a TV device, FM tuner, and AM tuner (not shown).

On the glass 10L, another antenna line 30 extends. The antenna line 30 is connected to the antenna line 20 at the feeding point 16, and extends along the edge portions of the glass 10L to have the feeding point 16 as a start point. The antenna line 20 mainly receives FM radio waves, and the antenna line 30 serves to receive AM radio waves together with the antenna line 20. More specifically, a primary antenna portion 30-1 of the antenna line 30 extends toward the rear portion of the vehicle body, and an additional antenna line 30-2 is connected to one terminal end of the primary antenna line 30-1 and extends substantially downward from the terminal end. Furthermore, an additional antenna line 30-3 is connected to one terminal end of the additional antenna line 30-2 and extends, from the terminal end, toward substantially the front portion of the vehicle body (in the left direction of the plane of the drawing of FIG. 1). Moreover, an additional antenna line 30-4 is connected to one terminal end of the additional antenna line 30-3 and extends substantially upward from the terminal end. In addition, an additional antenna line 30-5 is connected to one terminal end of the additional antenna line 30-4 and extends substantially rearward from the terminal end.

In the example shown in FIG. 1, if the horizontal dimension of upper peripheral portion of the glass 10L is assumed to be about 920 mm and the horizontal dimension of lower peripheral portion is assumed to be about 880 mm, the length of the FM reception antenna line 20-1 is set to be about 370 mm, the length of the additional antenna line 30-4 is set t o be about 370 mm, and the length of the additional antenna line 30-5 is set to be about 450 mm. In this case, the total length of the antenna line 30 is 2,300 mm. On the other hand, the antenna lines 30-1 and 30-5 are separated by about 50 mm from the end portion of the glass edge, the antenna line 30-2 is separated by about 35 mm from the end portion of the glass edge, and the antenna line 30-3 is separated by about 30 mm from the end portion of the glass edge. Furthermore, the additional antenna 20-2 is separated by 10 mm from the antenna line 30-3. Various experiments by the inventors with the antenna line 30 arranged on the outer peripheral portion give high sensitivity when it was separated by a distance falling within the range from about 10 mm to 30 mm from the glass edge (i.e., the boundary between the vehicle body and the glass).

Principle

In the first embodiment, the antenna line 20 is mainly used for receiving FM waves. On the other hand, for the AM frequency band, both the antenna lines 20 and 30 serve as an effective portion of antenna conductor. More specifically, the antenna lines 20-1 and 20-2 constitute an FM antenna, and both the antenna lines 20-1 and 20-2 and the antenna lines 30-1, 30-2, 30-3, 30-4, and 30-5 constitute an AM antenna.

The design principle of the AM/FM antenna system of the first embodiment lies in that the feeding point is arranged on an edge portion of the window glass, the antenna line 20 extends as a monopole type antenna from the feeding point as a start point in the vertical direction, and the AM antenna lines 20 and 30 extend in turn from the primary antenna portion 20-1 of the antenna line 20 along the edge of the glass 10L so as not to be separated farther away from the edge portion until a target length is obtained.

The antenna line 20 for receiving FM radio waves of high frequencies can be constituted by a monopole type antenna since it can have a smaller length than that of the AM antenna lines 20 and 30. In order to constitute a high-performance antenna system using the antenna lines 20 and 30, the AM antenna lines 20 and 30 preferably do not influence reception of FM radio waves by the FM antenna line 20. However, the antenna line 20 as a monopole type antenna is relatively short since it is arranged on the side window glass of the vehicle. Therefore, the impedance of the antenna line 20 itself inevitably becomes low (about 10 Ω), and the antenna line 20 is easily influenced by the AM antenna lines 20 and 30. Thus, in the first embodiment, the impedance is increased by extending a portion (30) of the AM antenna line along the edge portion of the glass.

Figure 2:
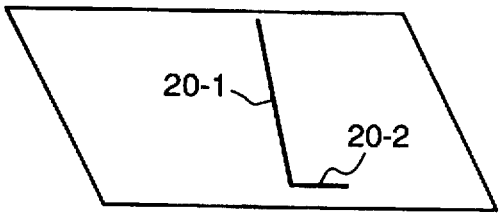
FIG. 2 is a view showing the influence of the length of an AM antenna line on the reception sensitivity when the length is increased, in the first embodiment.
Figure 3:
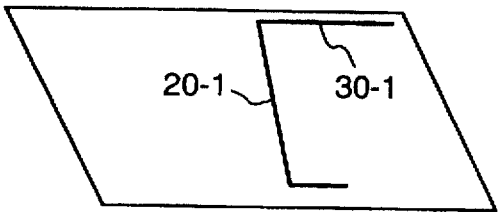
FIG. 3 is a view showing the influence of the length of an AM antenna line on the reception sensitivity when the length is increased, in the first embodiment.
Figure 4:
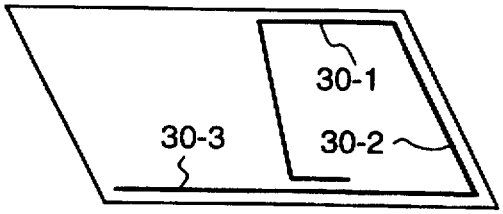
FIG. 4 is a view showing the influence of the length of an AM antenna line on the reception sensitivity when the length is increased, in the first embodiment.
Figure 5:
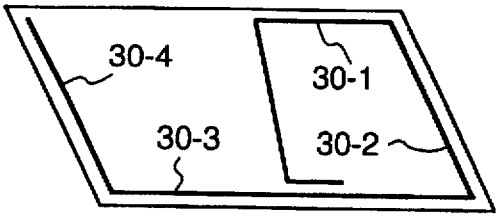
FIG. 5 is a view showing the influence of the length of an AM antenna line on the reception sensitivity when the length is increased, in the first embodiment.
Figure 6:
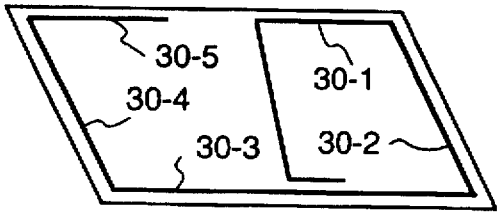
FIG. 6 is a view showing the influence of the length of an AM antenna line on the reception sensitivity when the length is increased, in the first embodiment.

FIGS. 2 to 6 are views when the length of the antenna line 30 is increased. When the reception sensitivity of AM radio waves obtained when only the antenna line 20 is arranged is assumed to be a reference (0 dB), as shown in FIG. 2, the sensitivity rises by 3 dB upon adding the AM line 30-1 (see FIG. 3); the sensitivity further rises by 1.9 dB upon adding the AM lines 30-2 and 30-3 (see FIG. 4); the sensitivity rises by 2.2 dB upon adding the AM line 30-4 (see FIG. 5); and the sensitivity rises by 1.5 dB upon adding the AM line 30-5 (see FIG. 6). More specifically, the antenna lines with the arrangement shown in FIG. 1 can raise the reception sensitivity by a total of 8.6 dB as compared to the antenna system shown in FIG. 2.

Improvement of AM Reception Sensitivity

Figure 7:
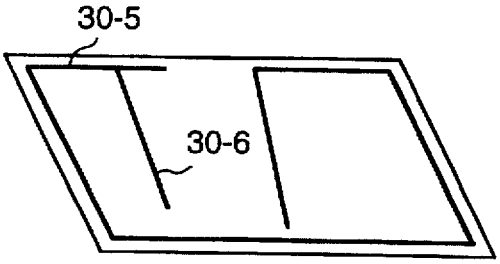
FIG. 7 is a view showing a modification in which an additional line 30-6 is provided to an AM reception antenna line 30 of the first embodiment (or second embodiment)

In FIG. 7, an additional line is added for the purpose of further improving the reception sensitivity of AM radio waves. More specifically, if the additional line 30-5 is further extended, it would approach the antenna line 20 and adversely influence the sensitivity of the FM antenna. In order to prevent this, an AM additional line 30-6 is added to extend parallel to the antenna line 20, as shown in FIG. 7. An additional line of the antenna line 30 should originally extend along the edge of the glass. Because the additional line extends to be separated away from the edge of the glass surface, as shown in FIG. 7, addition of additional antenna line gives less reception sensitivity. In this connection, in the example shown in FIG. 7, when the additional line 30-6 is added, the sensitivity rises by 0.6 dB. In order to expect further improvement of AM reception sensitivity, another additional line can be added parallel to the additional line 30-6.

The AM additional antenna line 30-6 can be arranged at a position where it does not disturb the view field of a driver/passenger, and is located at an intermediate position (need not be the center) between the antenna additional line 30-4 and the antenna line 20-1.

Note that the arrangement of AM additional line for raising the AM reception sensitivity can be applied to an antenna system of the second embodiment to be described later.

Countermeasure Against Breaking of Antenna Line

Figure 8:
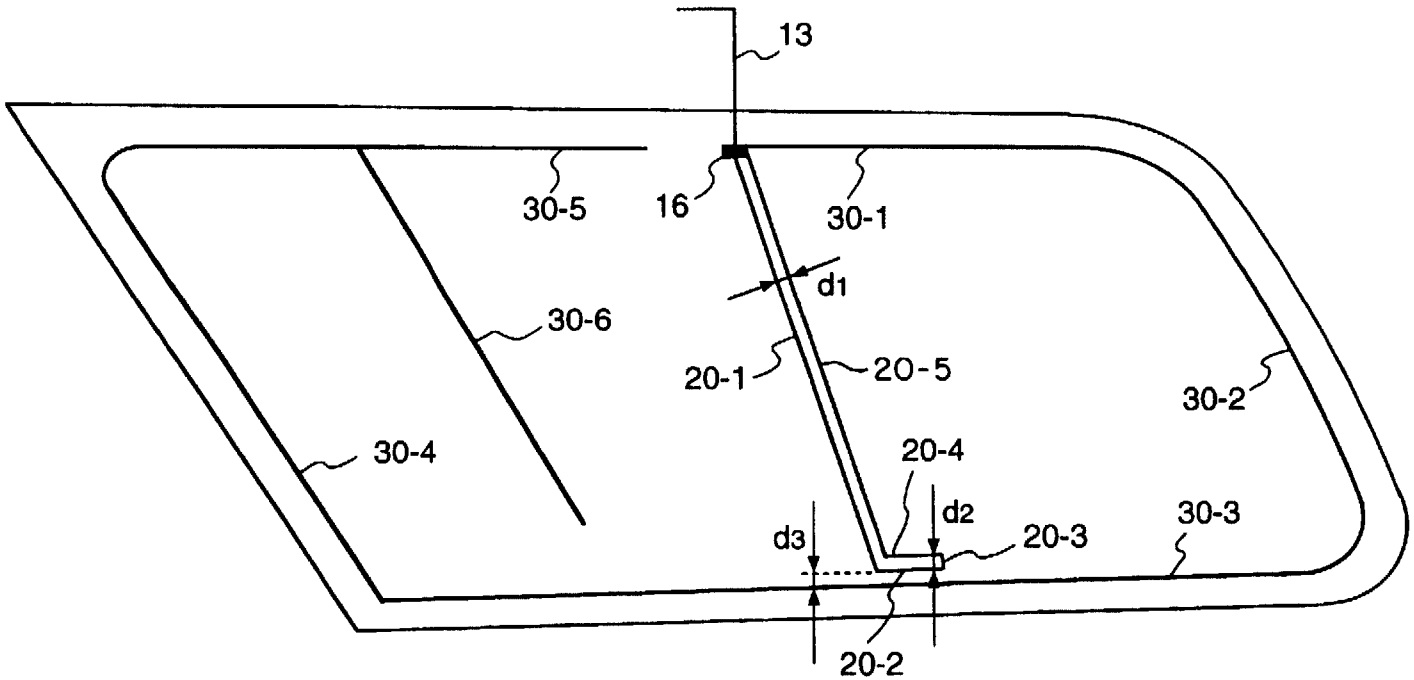
FIG. 8 is a view showing the arrangement obtained when an antenna line 20 of the first embodiment (or second embodiment) is doubled.

The side window glass of the vehicle is often rubbed against by a passenger during, e.g., cleaning. For this reason, the antenna line 20, which is important as an FM reception antenna, breaks with high probability. FIG. 8 shows a countermeasure against breaking of the line.

In FIG. 8, additional lines 20-3, 20-4, and 20-5 are further provided to the FM antenna line 20-2, and the terminal end of the additional line 20-5 is connected to the feeding point 16. With this layout, the FM antenna line 20-1 and the additional lines 20-2, 20-3, 20-4, and 20-5 form a single loop. In other words, the FM antenna line is doubled. Even when the antenna line breaks at any position, the broken FM antennas serve as two monopole type antennas, and the FM reception characteristics can be maintained.

Note that various distances shown in FIG. 8 are set to be $d_1=d_2=d_3$10 mm, so that the double FM antenna lines have an equivalent function.

Figure 9:
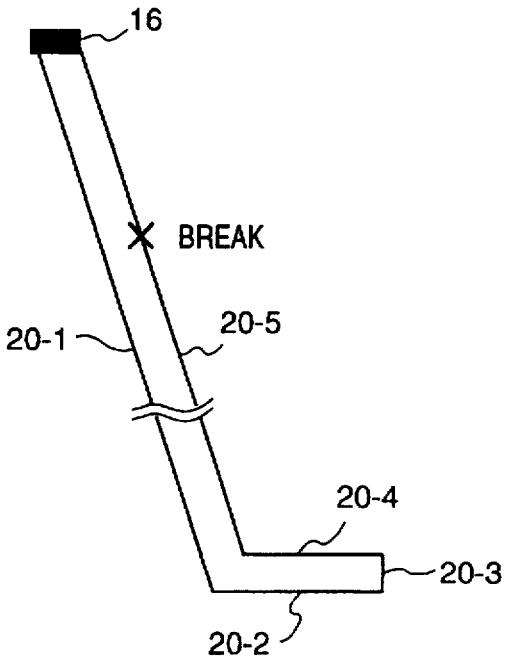
FIG. 9 is a view for explaining the effect of doubling an FM antenna line.
Figure 10:
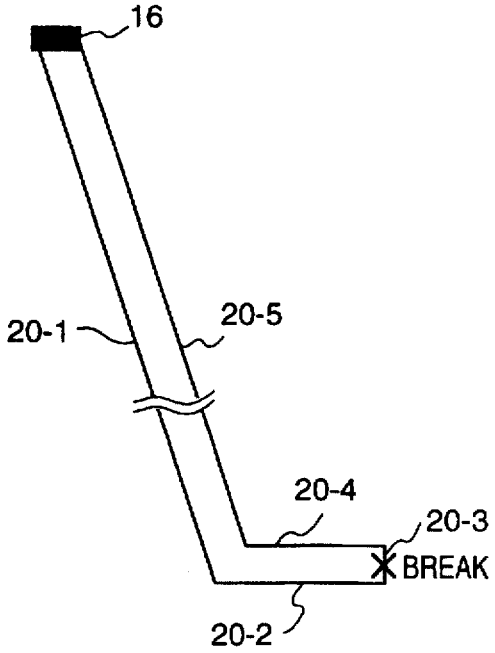
FIG. 10 is a view for explaining the effect of doubling an FM antenna line.

FIG. 9 shows a case wherein the additional line 20-5 is broken (i.e., the antenna line is broken halfway), and FIG. 10 shows a case wherein the additional line 20-3 is broken (i.e., the distal end portion of the antenna line is broken).

Figure 11:
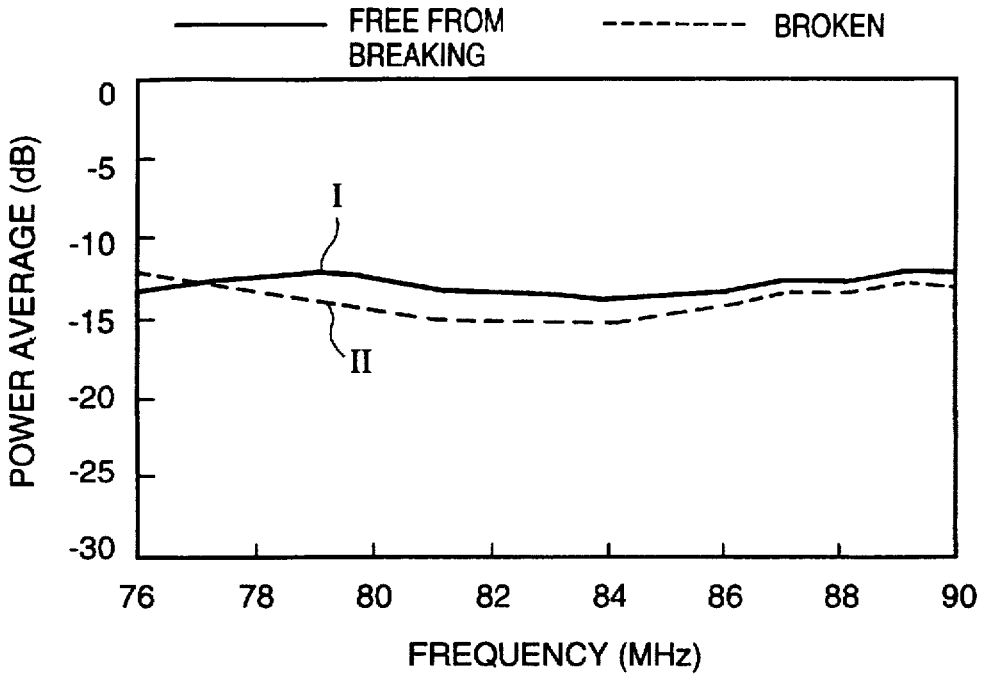
FIG. 11 is a graph for explaining the experimental results of the effect of doubling an FM antenna line.
Figure 12:
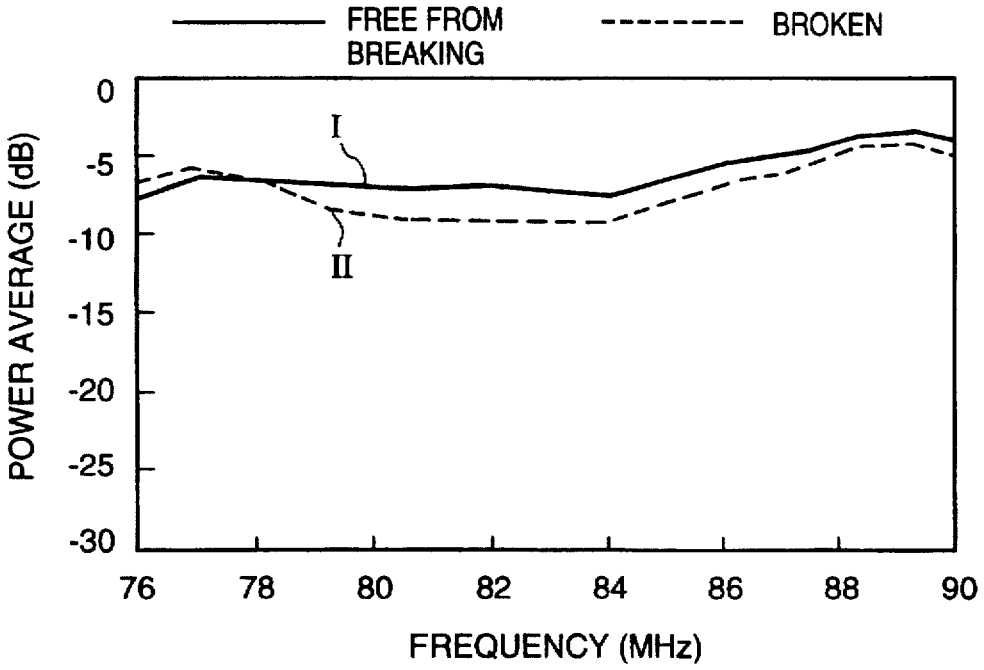
FIG. 12 is a graph for explaining the experimental results of the effect of doubling an FM antenna line.
Figure 13:
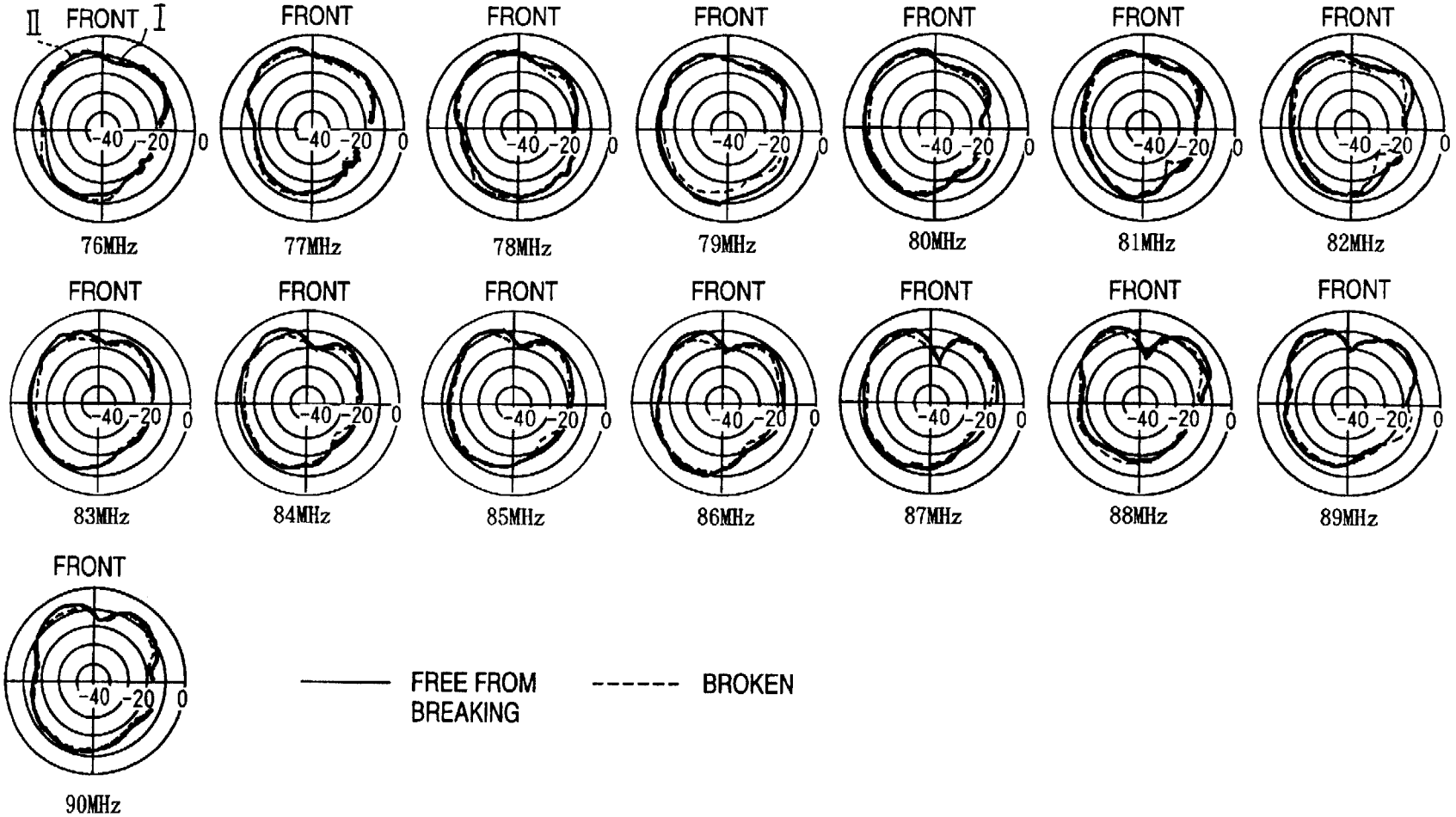
FIG. 13 is a graph for explaining the experimental results of the effect of doubling an FM antenna line.
Figure 14:
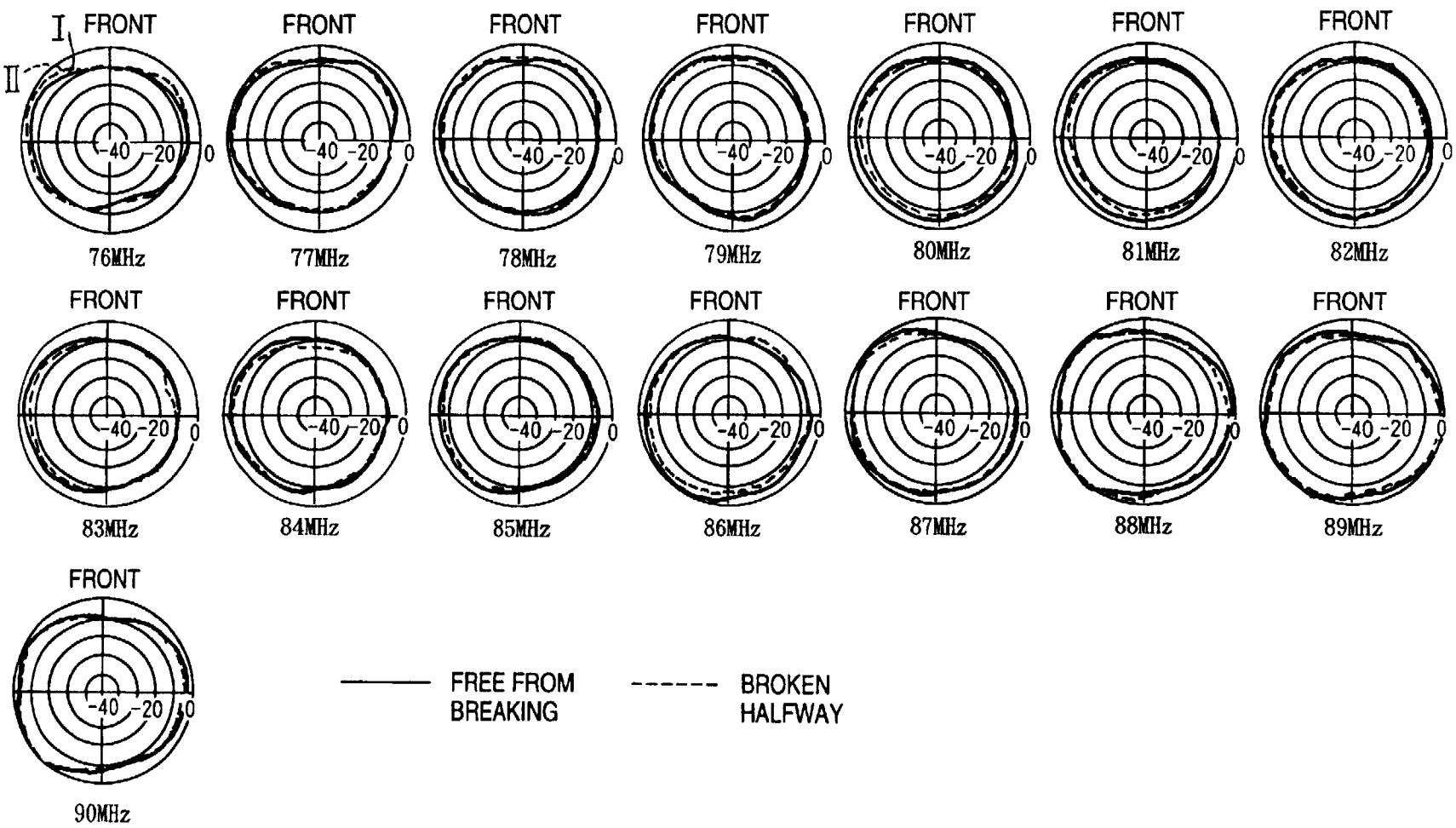
FIG. 14 is a graph for explaining the experimental results of the effect of doubling an FM antenna line.

Solid curves I in FIGS. 11 and 12 respectively represent the reception sensitivity characteristics for horizontally and vertically polarized waves when the antenna line is free from breaking. Broken curves II in FIGS. 11 and 12 respectively represent the reception sensitivity characteristics for horizontally and vertically polarized waves when the antenna line is broken, as shown in FIG. 9. As can be seen from FIGS. 11 and 12, even when the antenna line breaks, the sensitivity does not deteriorate to a degree that causes an audible difference. Solid curves I in FIGS. 13 and 14 respectively represent the directivity characteristics for horizontally and vertically polarized waves when the antenna line is free from breaking. Broken curves II in FIGS. 13 and 14 respectively represent the directivity characteristics for horizontally and vertically polarized waves when the antenna line is broken, as shown in FIG. 9. As can be seen from FIGS. 13 and 14, the directivity does not deteriorate even when the antenna line breaks.

Figure 15:
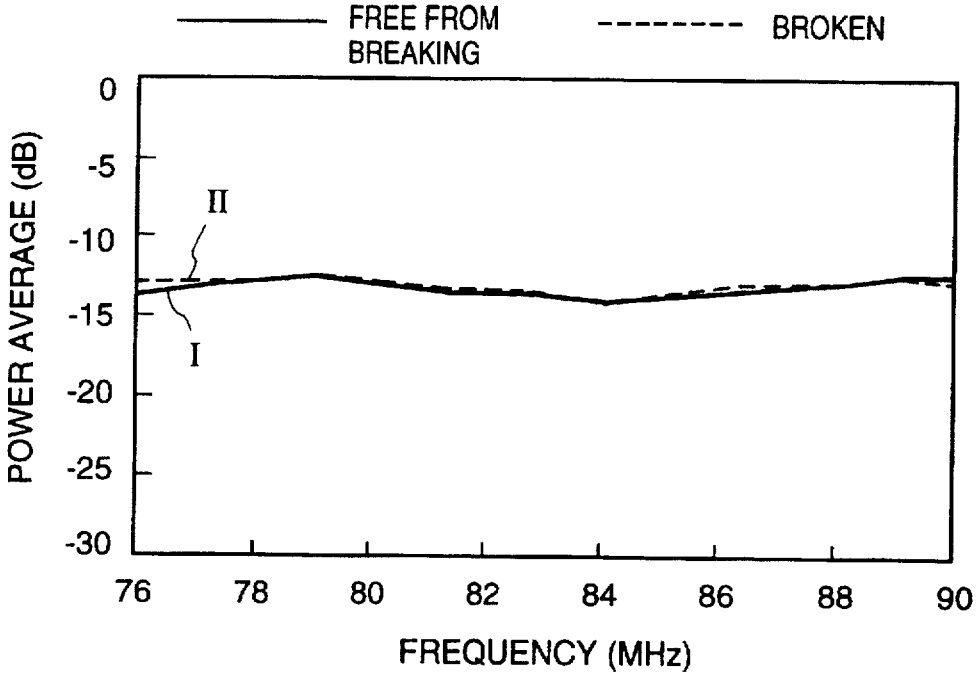
FIG. 15 is a graph for explaining the experimental results of the effect of doubling an FM antenna line.
Figure 16:
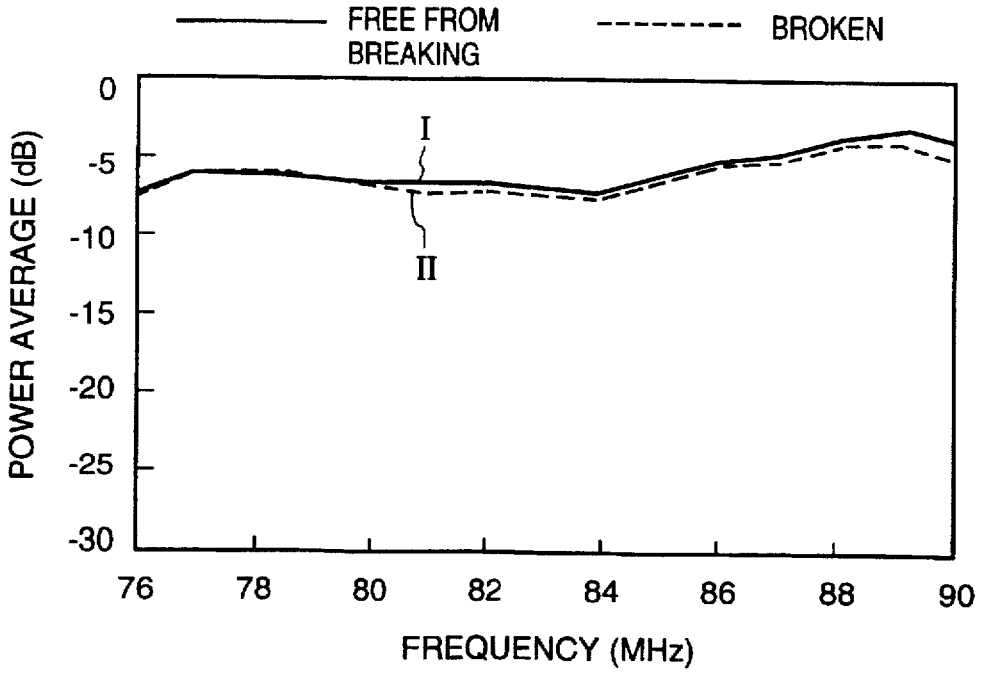
FIG. 16 is a graph for explaining the experimental results of the effect of doubling an FM antenna line.
Figure 17:
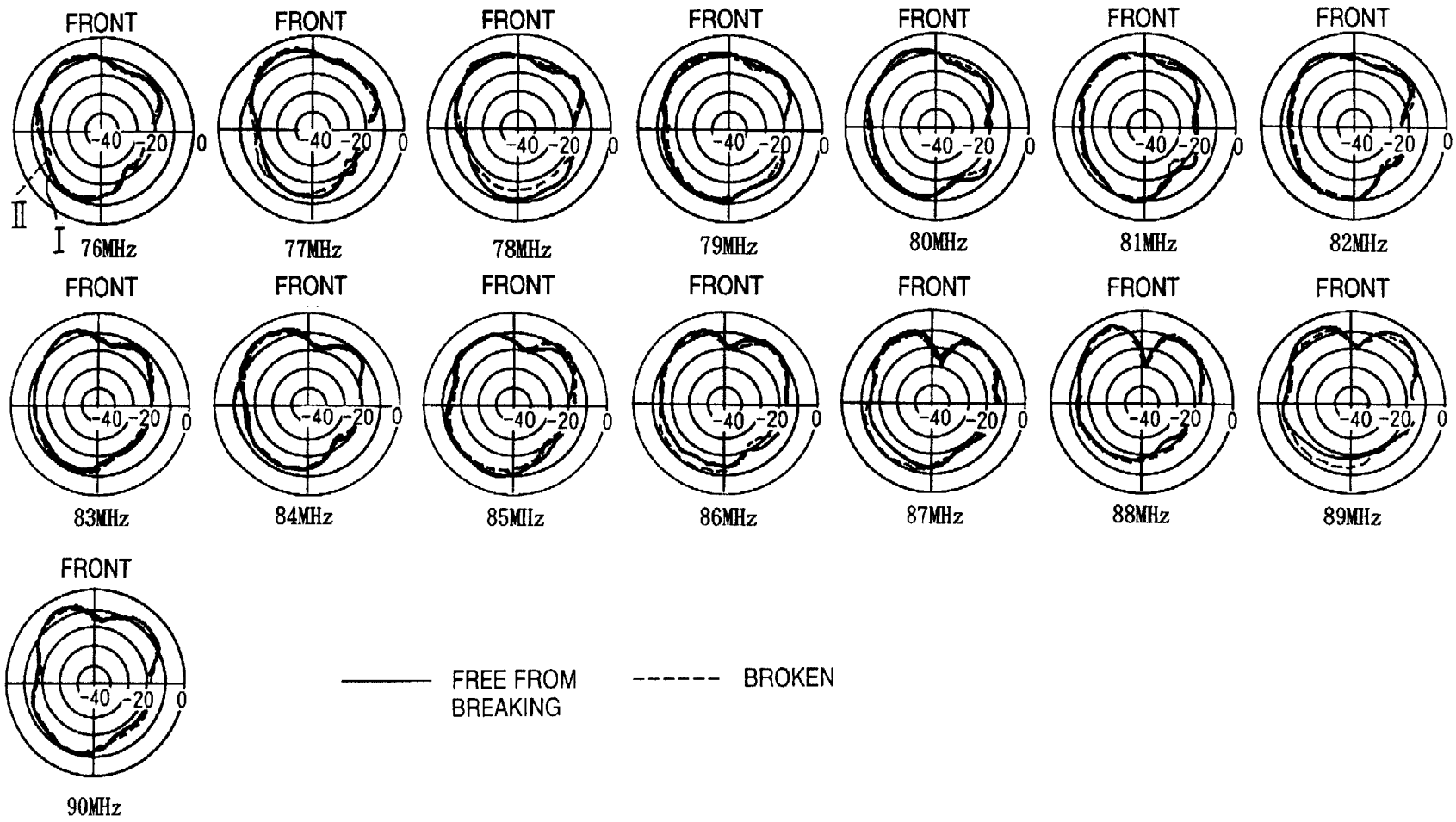
FIG. 17 shows charts for explaining the experimental results of the effect of doubling an FM antenna line.
Figure 18:
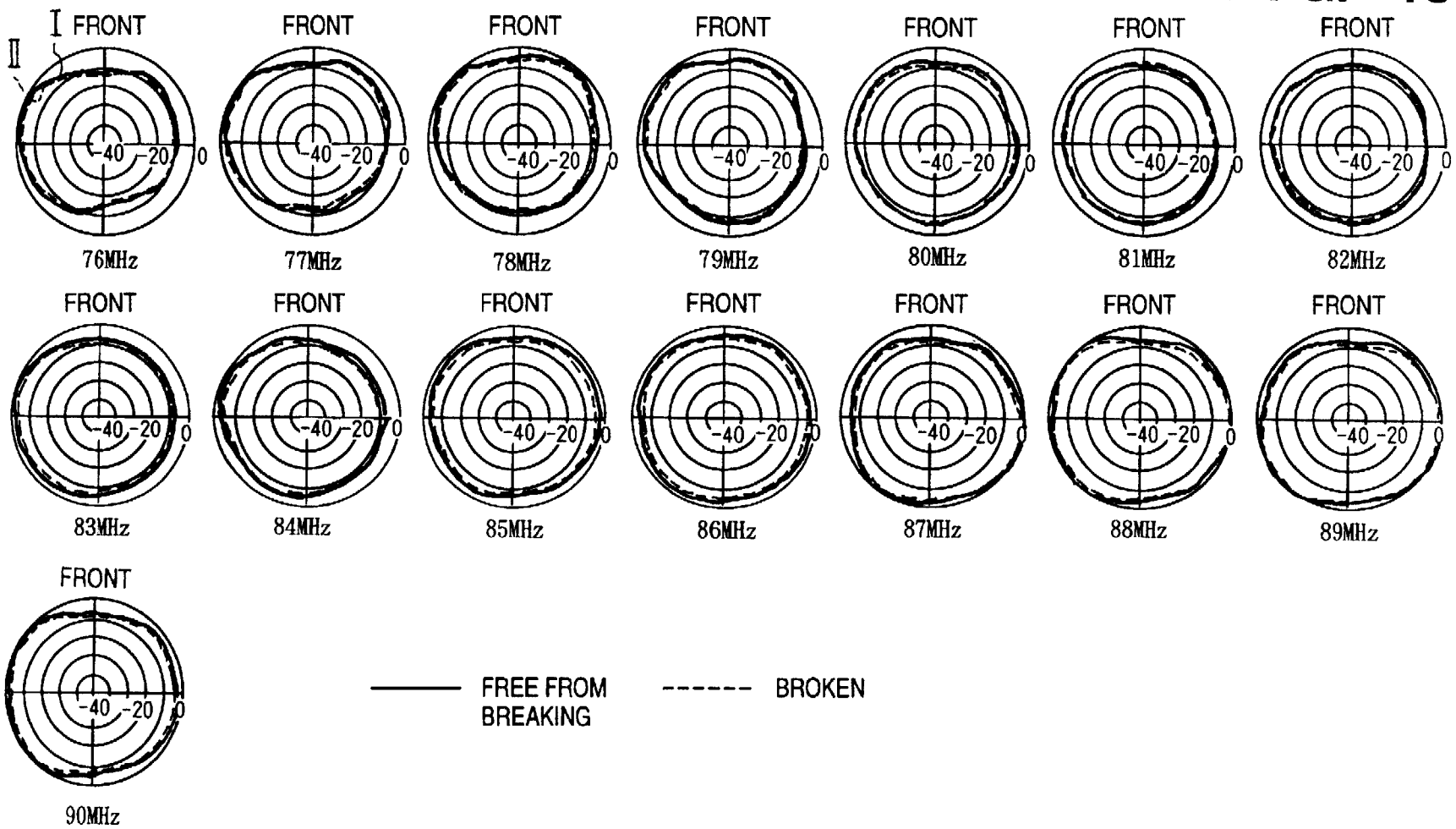
FIG. 18 shows charts for explaining the experimental results of the effect of doubling an FM antenna line.

Solid curves I in FIGS. 15 and 16 respectively represent the reception sensitivity characteristics for horizontally and vertically polarized waves when the antenna line is free from breaking. Broken curves II in FIGS. 15 and 16 respectively represent the reception sensitivity characteristics for horizontally and vertically polarized waves when the distal end portion of the antenna line is broken, as shown in FIG. 10. As can be seen from FIGS. 15 and 16, the sensitivity does not deteriorate to a degree that causes an audible difference. Solid curves I in FIGS. 17 and 18 respectively represent the directivity characteristics for horizontally and vertically polarized waves when the antenna line is free from breaking. Broken curves II in FIGS. 17 and 18 respectively represent the directivity characteristics for horizontally and vertically polarized waves when the antenna line is broken, as shown in FIG. 10. As can be seen from FIGS. 17 and 18, the directivity does not deteriorate even when the antenna line breaks.

Note that the above-mentioned countermeasure against breaking of the antenna line can be applied to an antenna system of the second embodiment to be described later.

Advantages of First Embodiment

According to the antenna system of the first embodiment described above:

(1): Despite the limitation that a large space cannot be assured on the side window glass, a required length of the FM antenna line is assured by folding the antenna lines in turn (for example, the antenna lines 20-1 and 20-2, or the antenna lines 30-1 to 30-5).

(2): Despite the limitation that a large space cannot be assured on the side window glass, i.e., the limitation that the FM antenna line inevitably has a low impedance, since the antenna line 30-1 serves as an open stub with respect to the FM reception antenna line 20, the AM antenna additional line 30 has no influence on the antenna line 20. More specifically, an antenna system in which AM and FM antenna lines do not influence each other's reception performance can be constituted.

(3): Since the antenna line extends along the glass edge, sufficiently high reception sensitivity can be assured for AM reception.

(4): A long antenna line must be assured for AM reception, and can only be assured on a rear glass with a large space in a conventional system. In addition, in order to improve the sensitivity, a defogger on the rear glass must be positively used. However, as described above, the side window glass has a small space and no wiring lines for the defogger. In the first embodiment of the present invention, since the AM antenna line is arranged along the edge of the window glass and can provide sufficiently high reception sensitivity, no defogger is required (a choke coil is not required, either, when the defogger is used), resulting in a simple arrangement as a whole.

<Second Embodiment>

In the second embodiment to be described below, the AM reception sensitivity is further improved. The second embodiment is characterized in that AM antenna lines extend across two glass surfaces.

Arrangement

Figure 19:
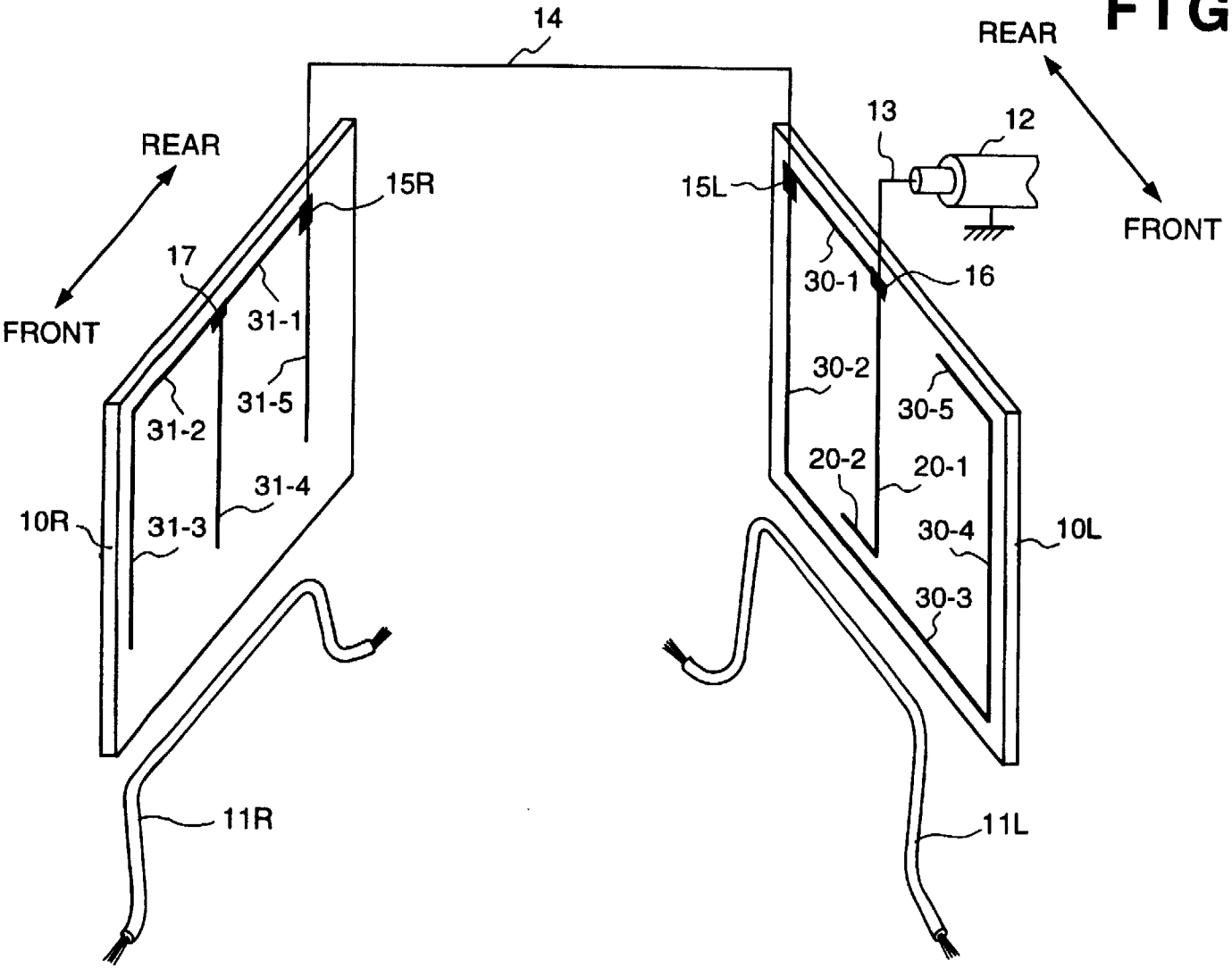
FIG. 19 is a view for explaining the arrangement according to the second embodiment of the present invention.

FIG. 19 is a view for explaining the arrangement of an antenna system according to the second embodiment. Referring to FIG. 19, a glass 10L represents a left side window glass as in the first embodiment, and a glass 10R represents a right side window glass which opposes the left side window glass 10L. For the sake of simplicity, the glasses 10L and 10R have a rectangular shape in FIG. 19, but actually have a substantially parallelogram shape as in the first embodiment, as shown in FIG. 20 or may have an arbitrary shape.

On the surface of the right side window glass 10R in FIG. 19, an AM antenna line 31 including AM reception additional antenna lines 31-1, 31-2, 31-3, 31-4, and 31-5 extends. An AM antenna line 30 arranged on the left side window glass 10L and the AM antenna line 31 arranged on the right side window glass 10R are connected via a connection line 14. The connection line 14 is connected to the AM antenna line 30 arranged on the left side window glass 10L at a connection point 15L, and is connected to the AM antenna line 31 arranged on the right side window glass 10R at a connection point 15R. More specifically, in the second embodiment, an antenna line 20 is mainly used for FM reception, and for the AM frequency band, the antenna line 20 and the antenna lines 30 and 31 serve as an antenna conductor. More specifically, antenna lines 20-1 and 20-2 constitute an FM antenna, and three sets of antenna lines, i.e., the antenna lines 20-1 and 20-2, antenna lines 30-1, 30-2, 30-3, 30-4, and 30-5, and the antenna lines 31-1, 31-2, 31-3, 31-4, and 31-5 constitute an AM antenna.

In FIG. 19, cables 11L and 11R are cable harnesses which are arranged below the glasses 10L and 10R and are normally concealed by the vehicle body.

Figure 20:
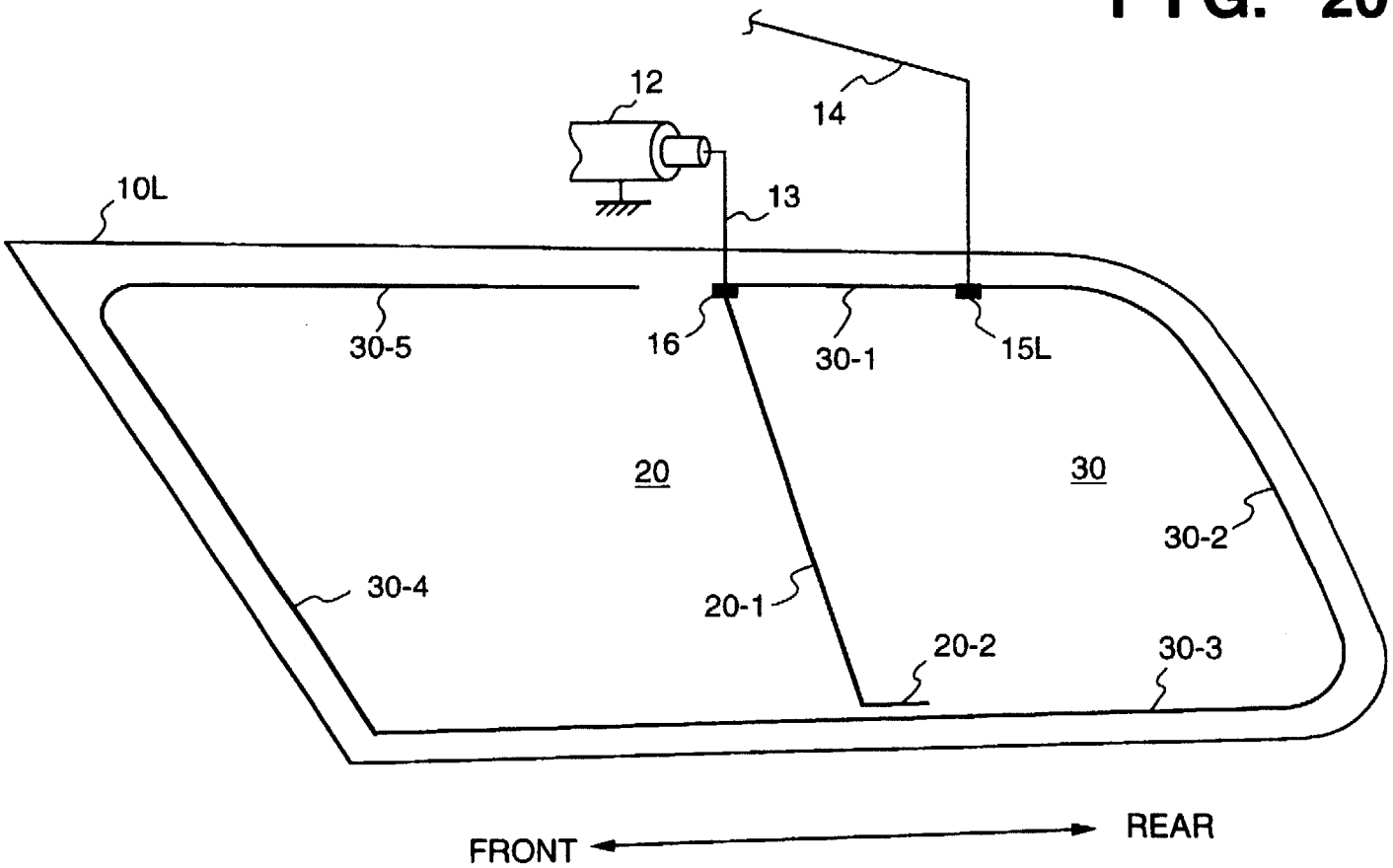
FIG. 20 is a view for explaining an antenna system on the left glass of the second embodiment.
Figure 21:
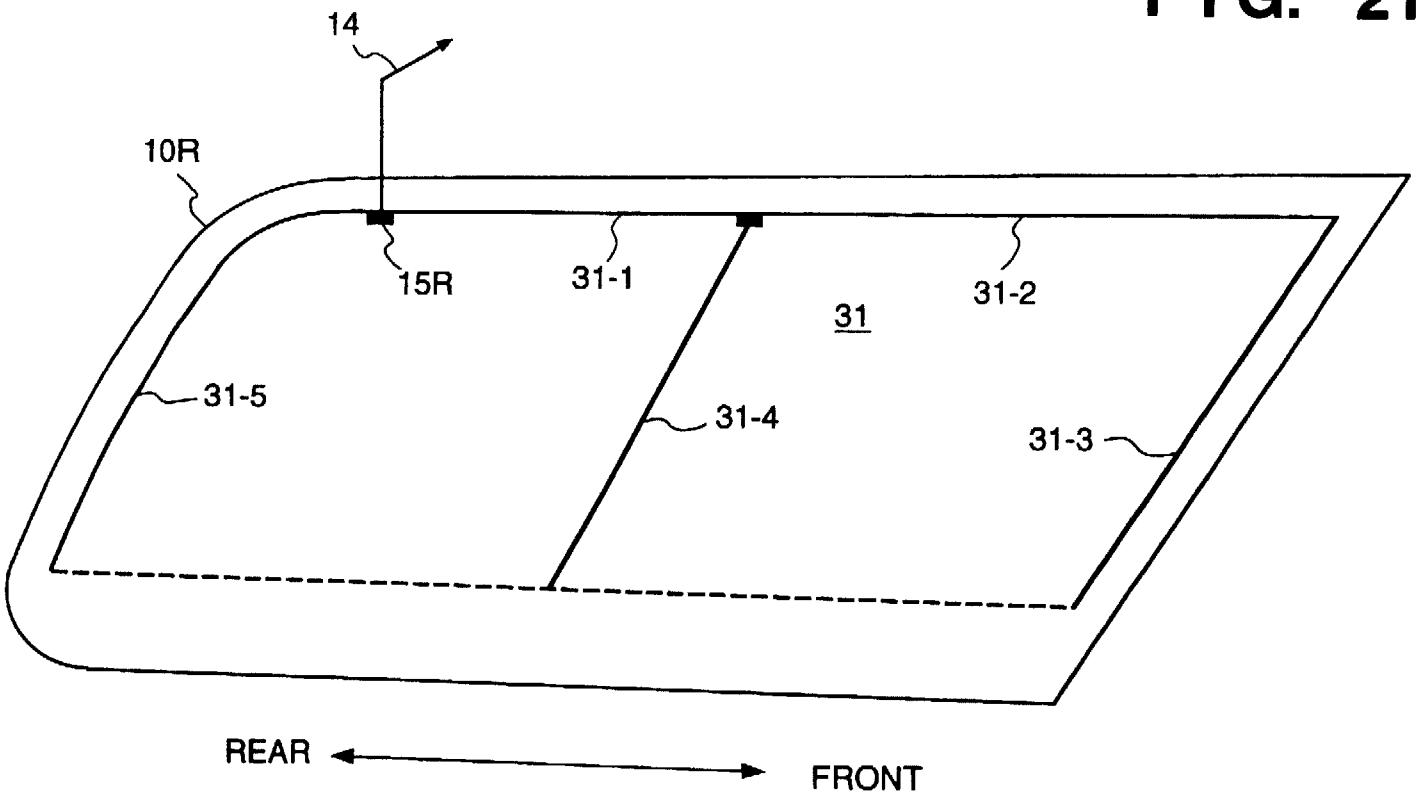
FIG. 21 is a view for explaining an antenna system on the right glass of the second embodiment.
Figure 22:
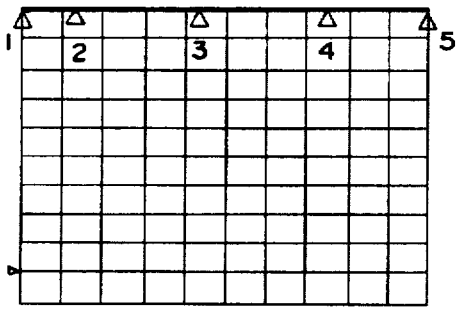
FIG. 22 is a graph for explaining the VSWR characteristics obtained when Q=20 cm in the second embodiment.
Figure 23:
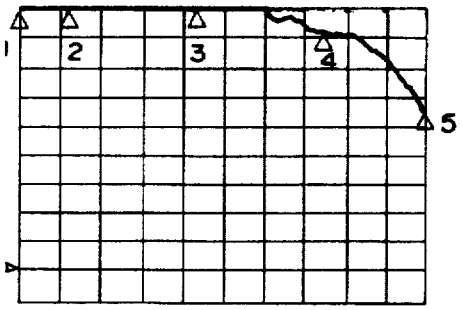
FIG. 23 is a graph for explaining the VSWR characteristics obtained when Q=40 cm in the second embodiment.
Figure 24:
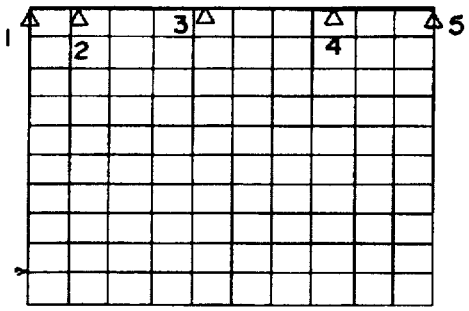
FIG. 24 is a graph for explaining the VSWR characteristics obtained when Q=60 cm in the second embodiment.
Figure 25:
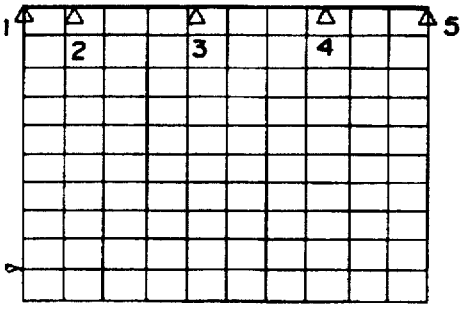
FIG. 25 is a graph for explaining the VSWR characteristics obtained when Q=80 cm in the second embodiment.
Figure 26:
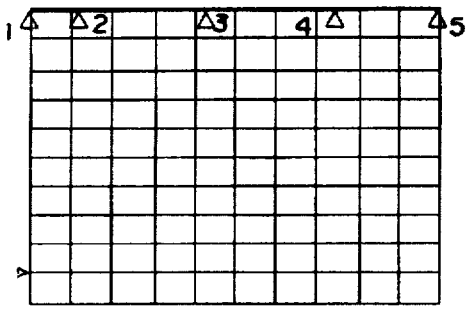
FIG. 26 is a graph for explaining the VSWR characteristics obtained when Q=100 cm in the second embodiment.
Figure 27:
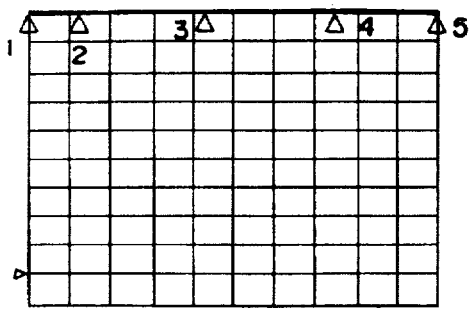
FIG. 27 is a graph for explaining the VSWR characteristics obtained when Q=120 cm in the second embodiment.
Figure 28:
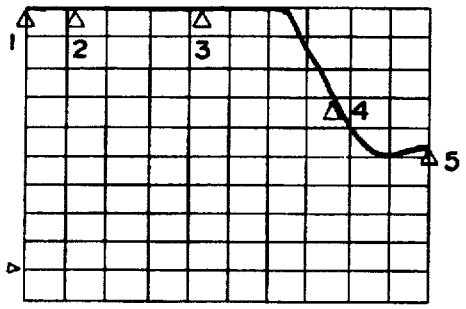
FIG. 28 is a graph for explaining the VSWR characteristics obtained when Q=140 cm in the second embodiment.
Figure 29:
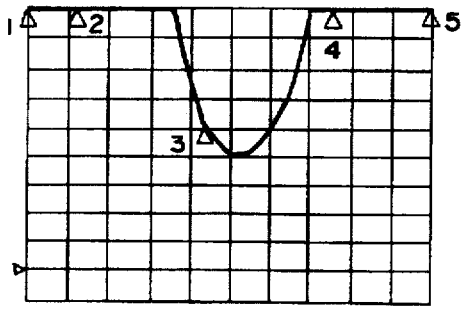
FIG. 29 is a graph for explaining the VSWR characteristics obtained when Q=160 cm in the second embodiment.
Figure 30:
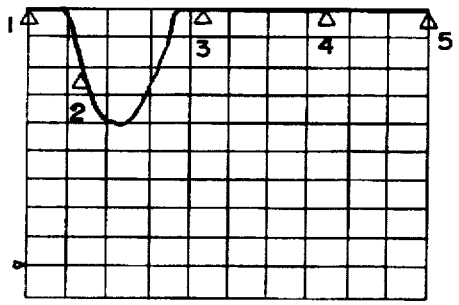
FIG. 30 is a graph for explaining the VSWR characteristics obtained when Q=180 cm in the second embodiment.
Figure 31:
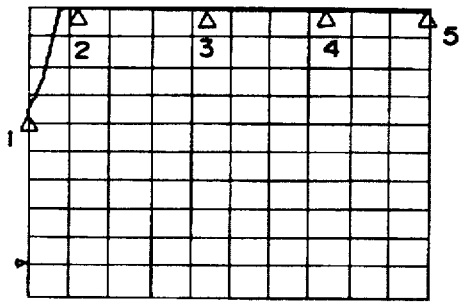
FIG. 31 is a graph for explaining the VSWR characteristics obtained when Q=200 cm in the second embodiment.
Figure 32:
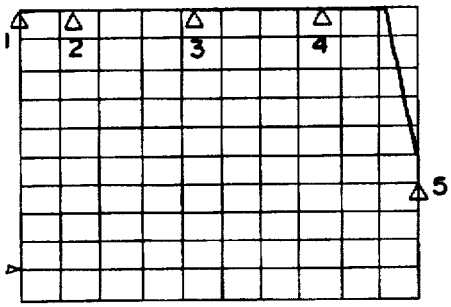
FIG. 32 is a graph for explaining the VSWR characteristics obtained when Q=220 cm in the second embodiment.
Figure 33:
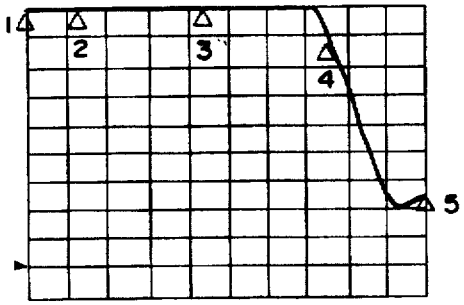
FIG. 33 is a graph for explaining the VSWR characteristics obtained when Q=235 cm in the second embodiment.
Figure 34:
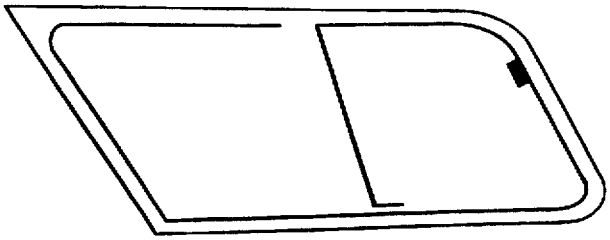
FIG. 34 is a view showing the connection position between a left antenna line 30 and a right antenna line 31 when Q=40 cm in the second embodiment.
Figure 35:
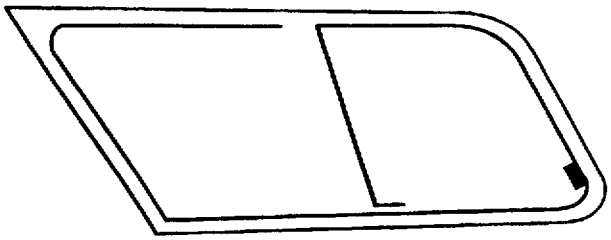
FIG. 35 is a view showing the connection position between the left antenna line 30 and the right antenna line 31 when Q=60 cm in the second embodiment.
Figure 36:
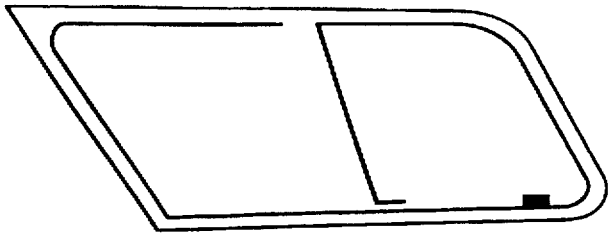
FIG. 36 is a view showing the connection position between the left antenna line 30 and the right antenna line 31 when Q=80 cm in the second embodiment.
Figure 37:
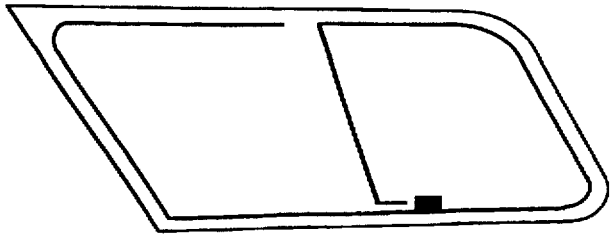
FIG. 37 is a view showing the connection position between the left antenna line 30 and the right antenna line 31 when Q=100 cm in the second embodiment.
Figure 38:
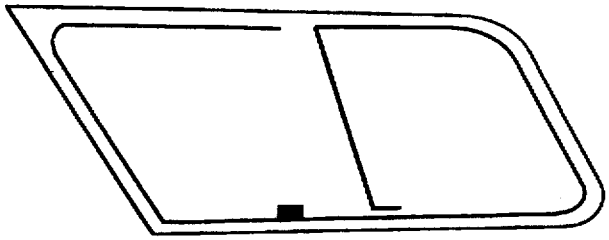
FIG. 38 is a view showing the connection position between the left antenna line 30 and the right antenna line 31 when Q=120 cm in the second embodiment.
Figure 39:
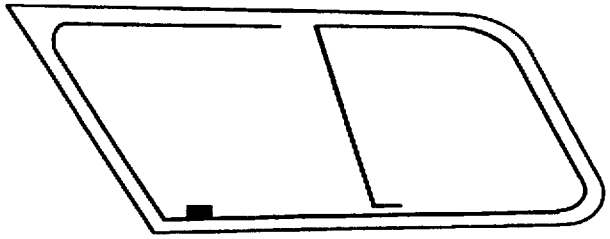
FIG. 39 is a view showing the connection position between the left antenna line 30 and the right antenna line 31 when Q=140 cm in the second embodiment.
Figure 40:
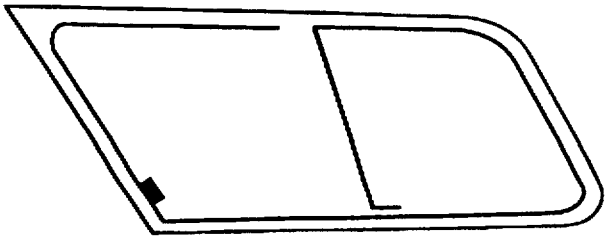
FIG. 40 is a view showing the connection position between the left antenna line 30 and the right antenna line 31 when Q=160 cm in the second embodiment.
Figure 41:
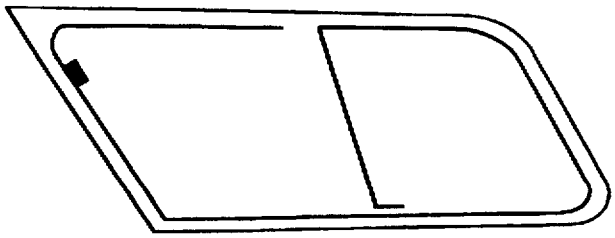
FIG. 41 is a view showing the connection position between the left antenna line 30 and the right antenna line 31 when Q=180 cm in the second embodiment.
Figure 42:
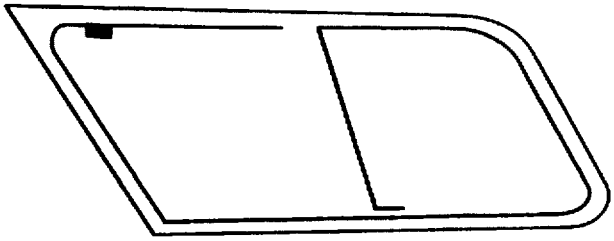
FIG. 42 is a view showing the connection position between the left antenna line 30 and the right antenna line 31 when Q=200 cm in the second embodiment.
Figure 43:
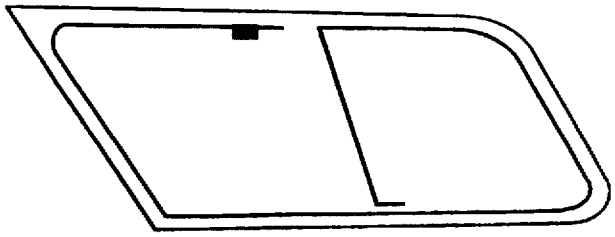
FIG. 43 is a view showing the connection position between the left antenna line 30 and the right antenna line 31 when Q=220 cm in the second embodiment.
Figure 44:
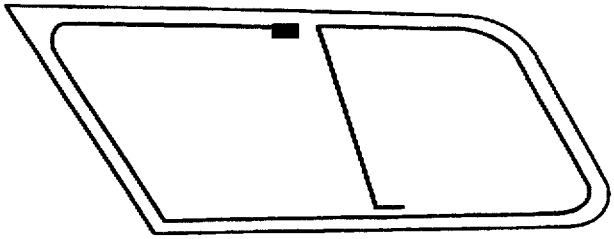
FIG. 44 is a view showing the connection position between the left antenna line 30 and the right antenna line 31 when Q=235 cm in the second embodiment.

FIG. 20 shows the layout of the antenna lines 20 and 30 extending on the left side window glass 10L shown in FIG. 19. FIG. 21 shows the layout of the AM antenna line 31 extending on the right side window glass 10R. Upon comparison between FIG. 20 of the second embodiment and FIG. 1 of the first embodiment, a large difference therebetween is that the connection line 14 is connected at the connection point 15L.

Open Stub Structure

As in the first embodiment described above, extension of AM antenna lines must not have any adverse influence on the reception of FM radio waves. On the other hand, as in the first embodiment, since the left side window glass has a small space, the impedance of the antenna line is inevitably low.

Referring to FIGS. 19 and 20, a line, between the feeding point 16 and the connection point 15L, of the AM antenna line 30-1 serves as a stub for attaining impedance matching between the antenna line and a feeder line 13. A stub is normally used for attaining impedance matching between an antenna line and a feeder line. Since the distribution constant of the stub portion changes the impedance of the antenna line, the length of the stub portion is appropriately determined to attain impedance matching between the antenna line and the feeder line and to eliminate generation of reflected waves.

The second embodiment is characterized in that the connection line for connecting the antenna lines on the right and left glasses serves as a normal stub by using a normal AV line in place of a coaxial cable and by appropriately setting the position of the connection point 15L, and the AM antenna line 30 on the left glass 10L and the AM antenna line 31 on the right glass 10R are set to have a higher impedance when viewed from the antenna line 20. When the antenna lines 30 and 31 have a higher impedance when viewed from the FM antenna line 20, the AM antenna lines 30 and 31 stand as if they did not exist from the viewpoint of the FM antenna line 20, and their influence on the antenna line 20 is negligible.

FIGS. 22 to 33 show the impedance characteristics (VSWR) for the respective FM frequencies obtained when the position of the connection point 15L of the connection line 14 to be connected to the antenna line 31 on the right glass is variously changed on the left glass surface. In FIGS. 22 to 33, l is the distance between the connection point 15L and the feeding point 16, and l=20 cm (FIG. 22) corresponds to a case wherein the connection point 15L is located at the position illustrated in FIG. 20. FIGS. 34 to 44 respectively show the positions of the connection point 15L in the VSWR graphs shown in FIGS. 23 to 33.

Figure 45:
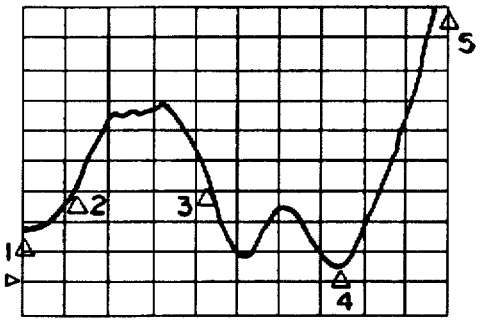
FIG. 45 is a graph for explaining the VSWR characteristics of the first embodiment.

FIG. 45 is a VSWR graph obtained when no right side glass is present. As can be seen from FIGS. 22 to 33, high VSWR characteristics can be obtained over a broad frequency range when the connection point 15L is separated from the feeding point 16 by an appropriate distance and is set at the edge of the glass surface. Furthermore, as can be seen from FIG. 45, when the AM antenna lines are present on the right and left glasses, higher VSWR characteristics can be obtained as compared to a case wherein no AM antenna line is present on the right glass.

As described above, according to the second embodiment, even when the AM antenna line 31 is present on the right glass 10R, the antenna line 31 has a higher impedance than that of the antenna line 20, and its presence has no influence on the FM reception characteristics.

Figure 46:
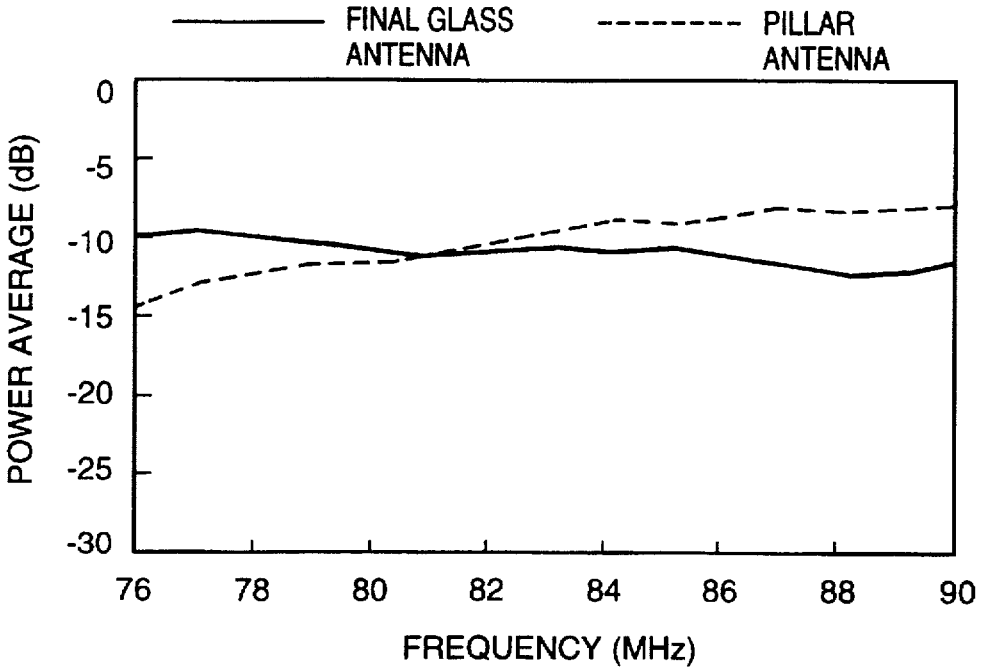
FIG. 46 is a graph showing the reception sensitivity characteristics for horizontally polarized FM radio wave reception of the second embodiment and a conventional pillar antenna.
Figure 47:
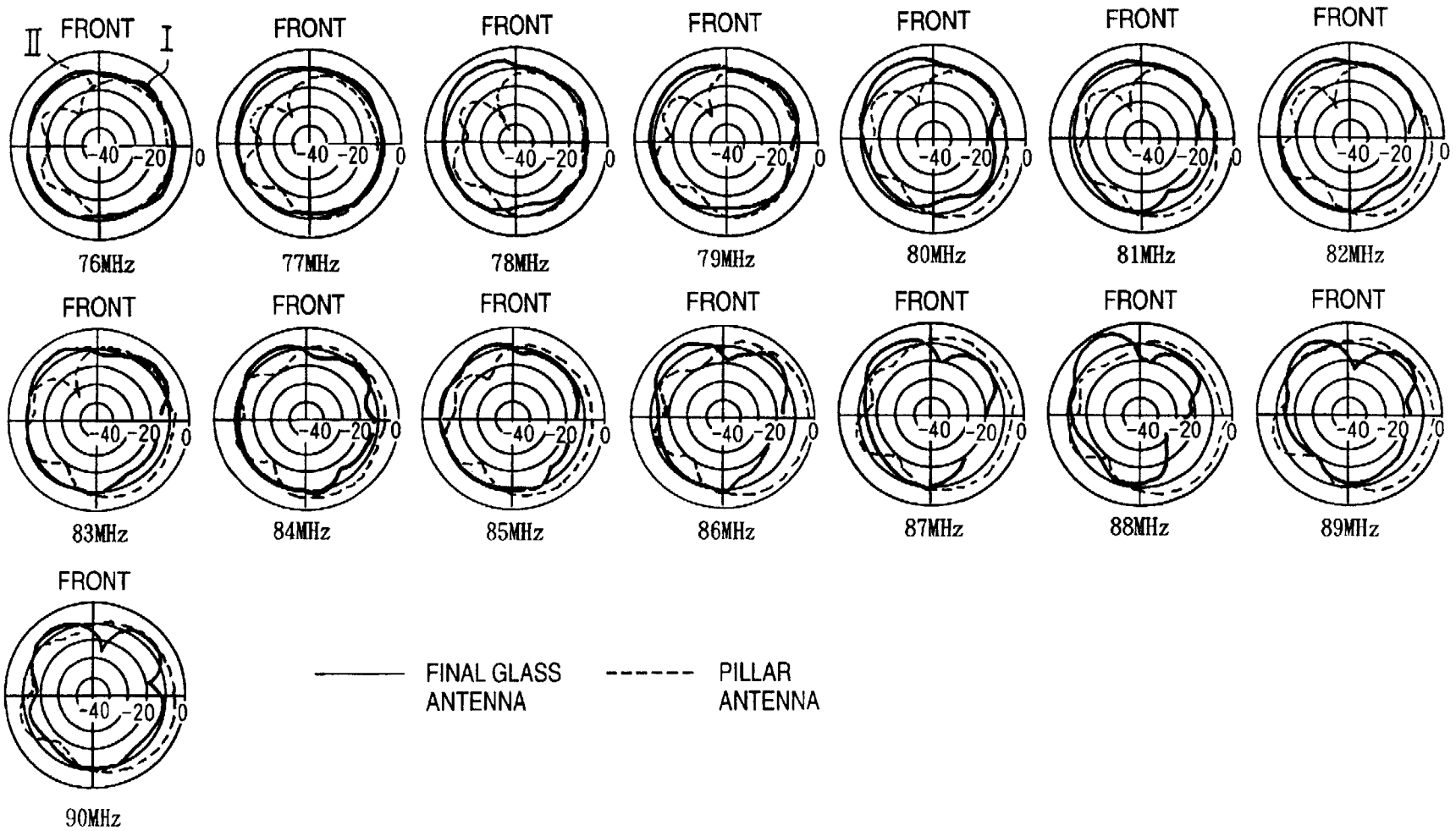
FIG. 47 shows charts showing the directivity performance for horizontally polarized FM radio wave reception of the second embodiment and a conventional pillar antenna.
Figure 48:
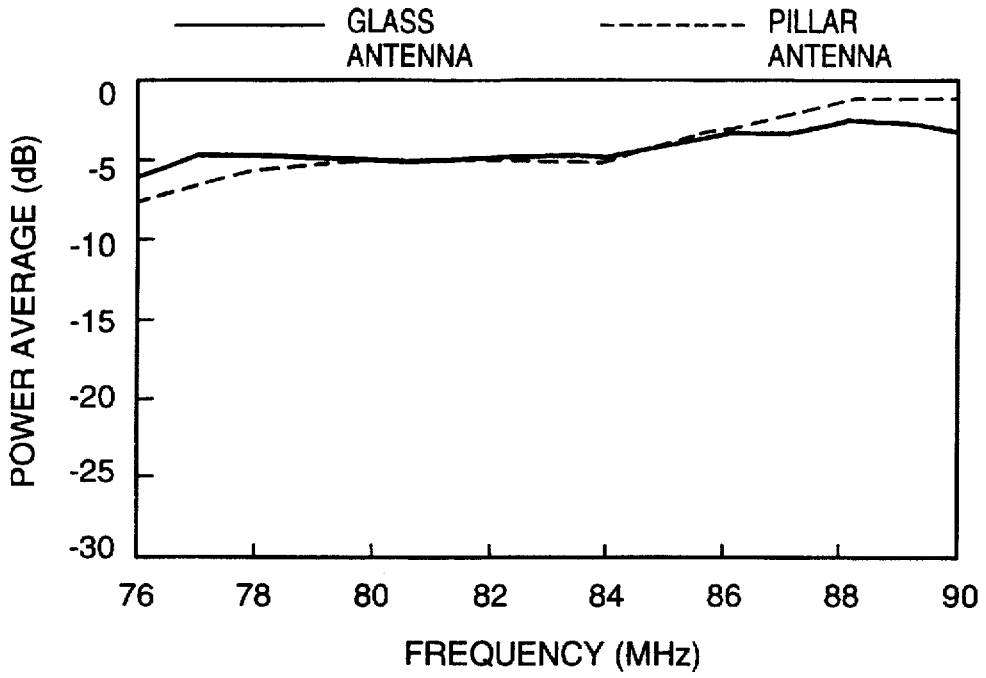
FIG. 48 is a graph showing the reception sensitivity characteristics for vertically polarized wave FM radio wave reception of the second embodiment and a conventional pillar antenna.

FIG. 46 shows the reception sensitivity characteristics (solid curve) obtained when horizontally polarized FM radio waves are received by the antenna system having an open stub structure (the structure having the AM line 30) of the second embodiment, and the reception sensitivity characteristics (broken curve) obtained when horizontally polarized FM radio waves are received by an antenna system (not shown) arranged on a pillar. Similarly, FIG. 47 shows the directivity characteristics (solid curve) obtained when horizontally polarized FM radio waves are received by the antenna system of the second embodiment, and the directivity characteristics (broken curve) obtained when horizontally polarized FM radio waves are received by the pillar antenna system. Also, FIG. 48 shows the reception sensitivity characteristics (solid curve) obtained when vertically polarized FM radio waves are received by the antenna system of the second embodiment, and the reception sensitivity characteristics (broken curve) obtained when vertically polarized FM radio waves are received by the pillar antenna system. FIGS. 46 to 48 reveal that the FM reception performance of the antenna system having a stub structure of the second embodiment is equivalent to that of the pillar antenna system.

Figure 49:
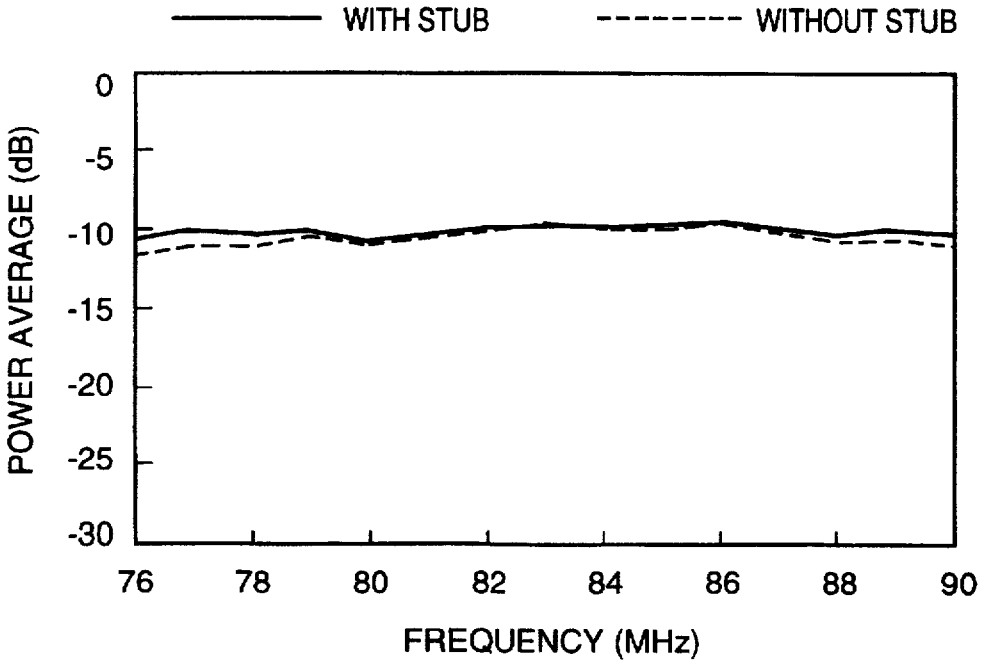
FIG. 49 is a graph for explaining the influence of a stub on the reception of FM radio waves (horizontally polarized waves in the range from 76 to 88 MHz) in the second embodiment.
Figure 50:
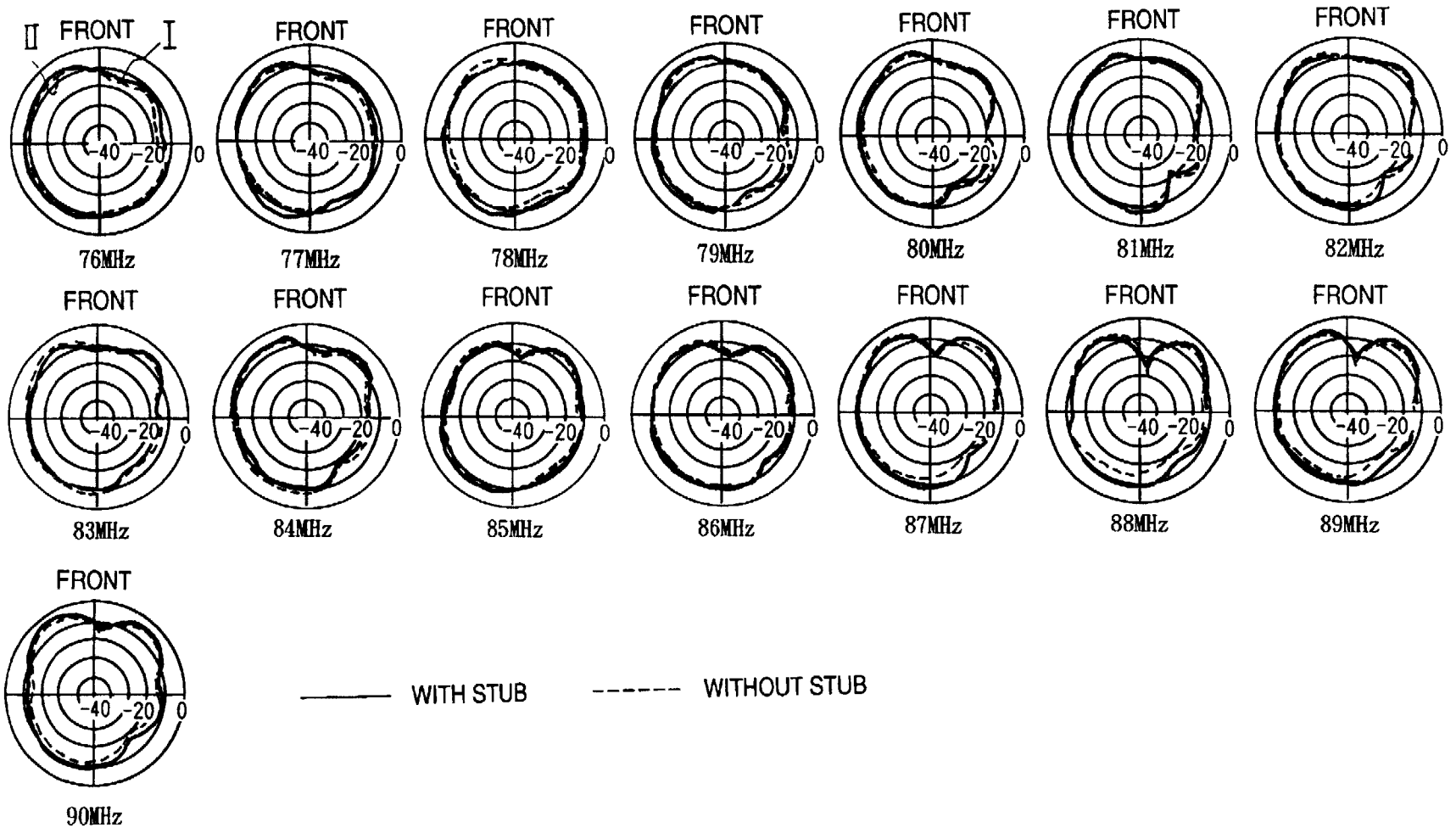
FIG. 50 shows charts for explaining the influence of a stub on the directivity of reception of FM radio waves (horizontally polarized waves in the range from 76 to 88 MHz) in the second embodiment.
Figure 51:
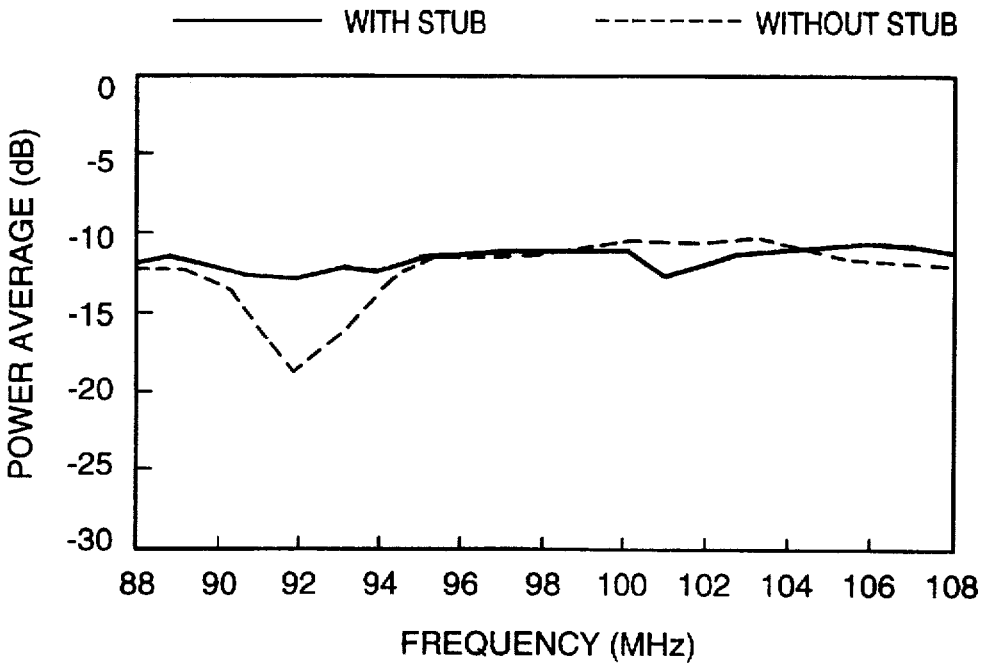
FIG. 51 is a graph for explaining the influence of a stub on the reception of FM radio waves (horizontally polarized waves in the range from 88 to 108 MHz) in the second embodiment.
Figure 52:
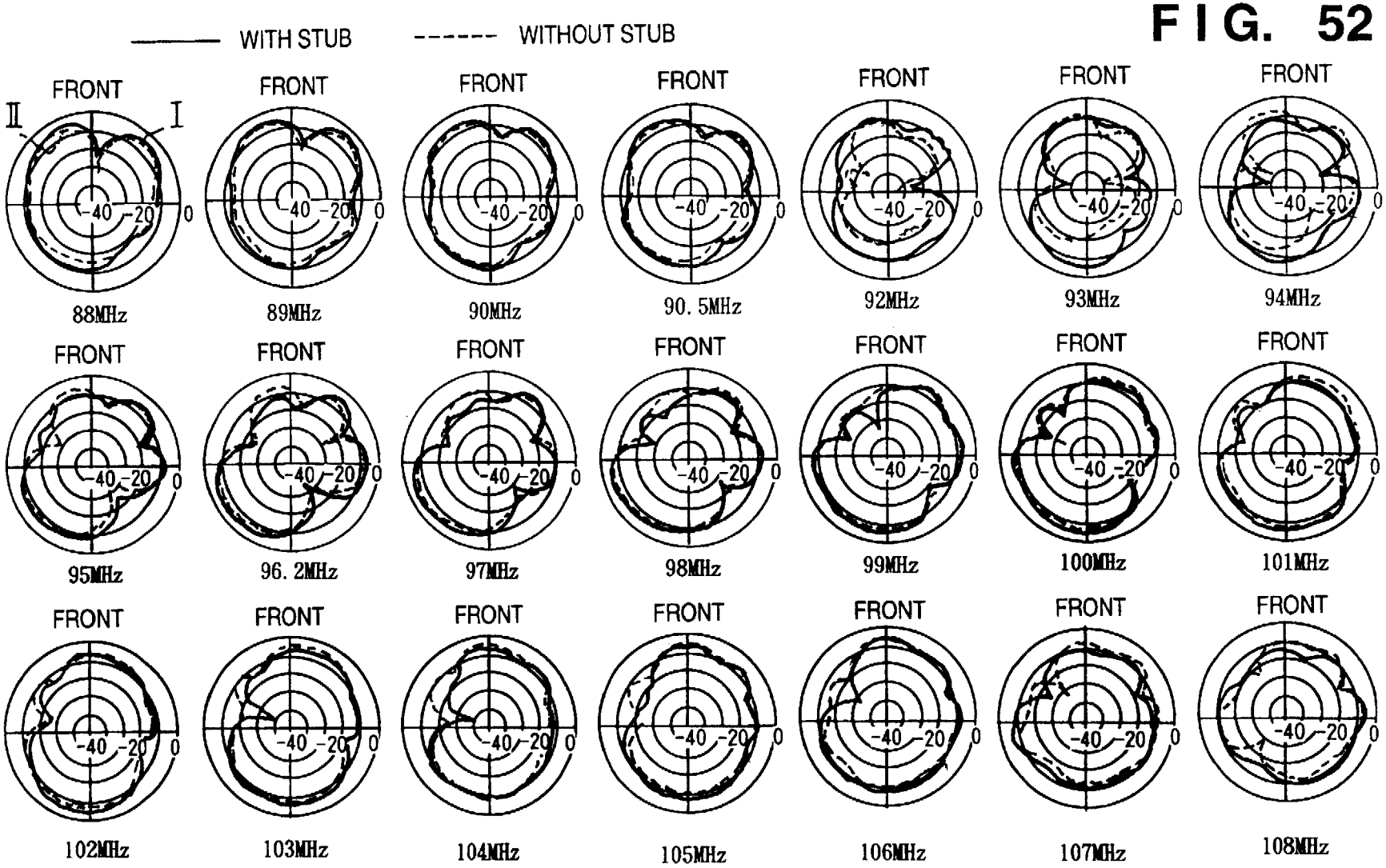
FIG. 52 shows charts for explaining the influence of a stub on the directivity of reception of FM radio waves (horizontally polarized waves in the range from 88 to 108 MHz) in the second embodiment.
Figure 53:
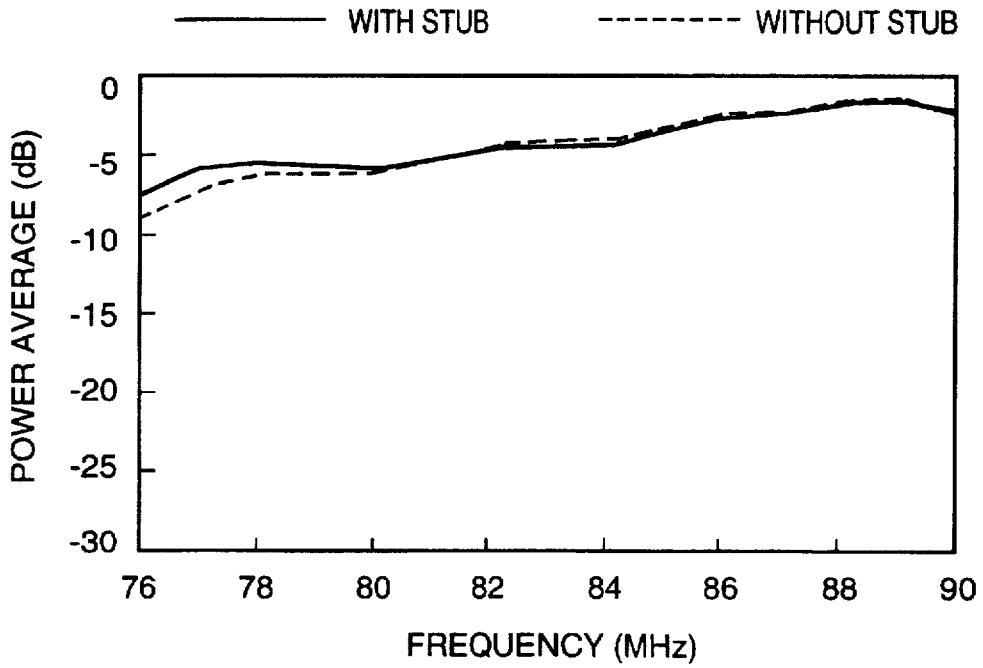
FIG. 53 is a graph for explaining the influence of a stub on the reception of FM radio waves (vertically polarized waves in the range from 76 to 88 MHz) in the second embodiment.
Figure 54:
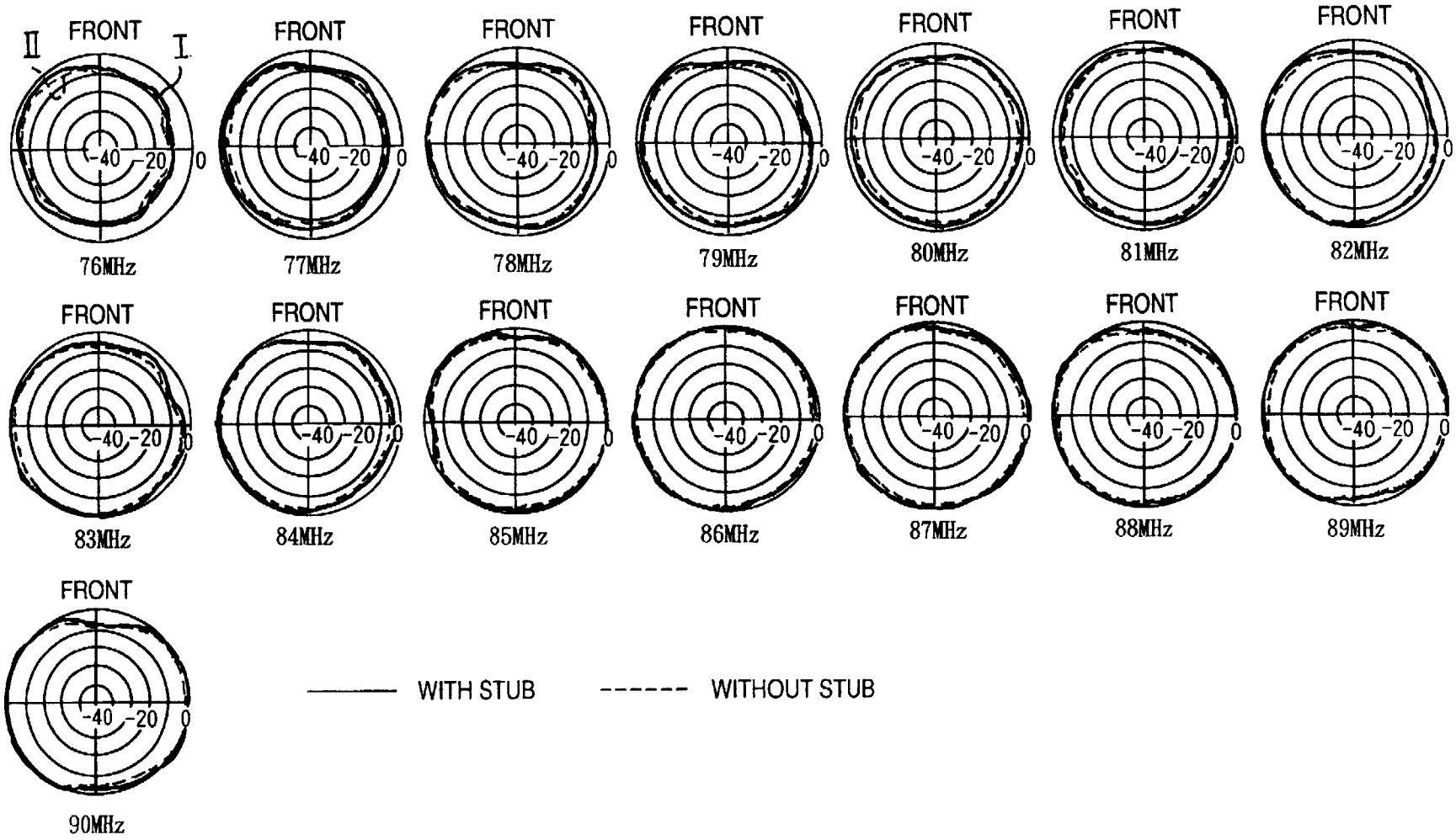
FIG. 54 shows charts for explaining the influence of a stub on the directivity of reception of FM radio waves (vertically polarized waves in the range from 76 to 88 MHz) in the second embodiment.

FIG. 49 shows the reception sensitivity characteristics (solid curve) obtained when horizontally polarized FM radio waves (76 MHz to 90 MHz) are received by the antenna system having an open stub structure (the structure having the AM additional line 30) of the second embodiment, and the reception sensitivity characteristics (broken curve) obtained when the horizontally polarized FM radio waves are received by an antenna system without any stub structure (not shown; an antenna system constituted by only the antenna line 20 without any AM antenna line 30 in FIG. 20). FIG. 50 shows charts for comparing the directivity characteristics for the FM radio waves between the antenna system (solid curve) of the second embodiment and an antenna system (broken curve) without any stub structure. FIG. 51 shows the reception sensitivity characteristics (solid curve) obtained when horizontally polarized FM radio waves (88 MHz to 108 MHz) are received by the antenna system having a stub structure of the second embodiment, and the reception sensitivity characteristics (broken curve) obtained when the horizontally polarized FM radio waves are received by the antenna system without any stub structure. FIG. 52 shows charts for comparing the directivity characteristics for the FM radio waves between the antenna system (solid curve) of the second embodiment and an antenna system (broken curve) without any stub structure. FIG. 53 shows the reception sensitivity characteristics (solid curve) obtained when vertically polarized FM radio waves (76 MHz to 90 MHz) are received by the antenna system having a stub structure of the second embodiment, and the reception sensitivity characteristics (broken curve) obtained when the vertically polarized FM radio waves are received by the antenna system without any stub structure. FIG. 54 shows charts for comparing the directivity characteristics for the FM radio waves between the antenna system (solid curve) of the second embodiment and an antenna system (broken curve) without any stub structure.

FIGS. 49 to 54 indicate that the AM antenna line for the stub structure has no influence on the reception performance (reception sensitivity and directivity) of FM radio waves.

Comparison With First Embodiment

Figure 55:
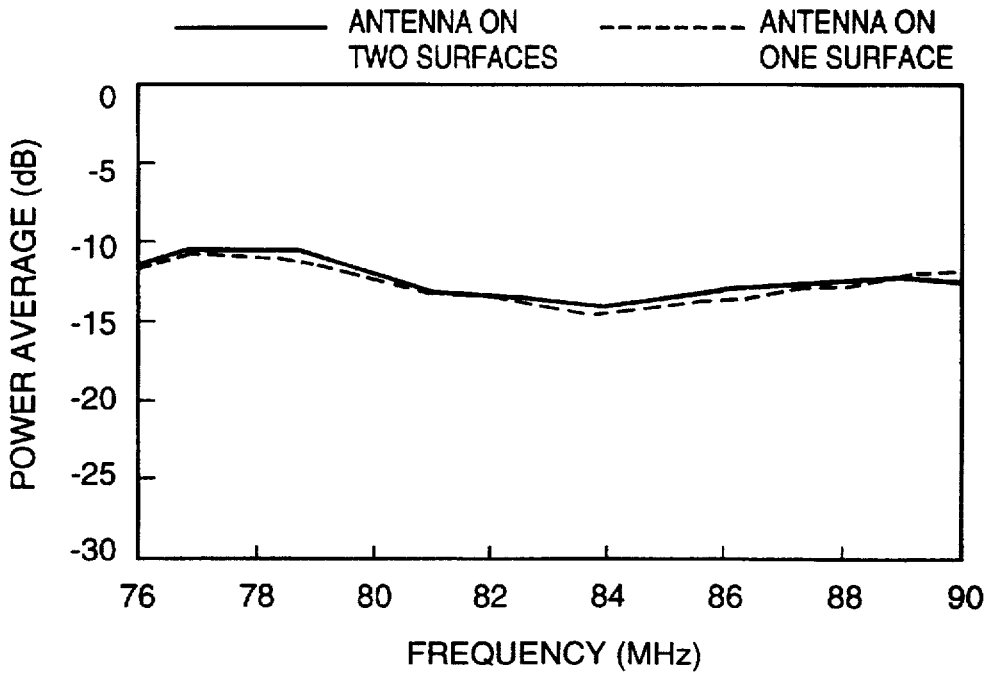
FIG. 55 is a graph for comparing the performances obtained when the right glass antenna is and is not arranged in the second embodiment.
Figure 56:
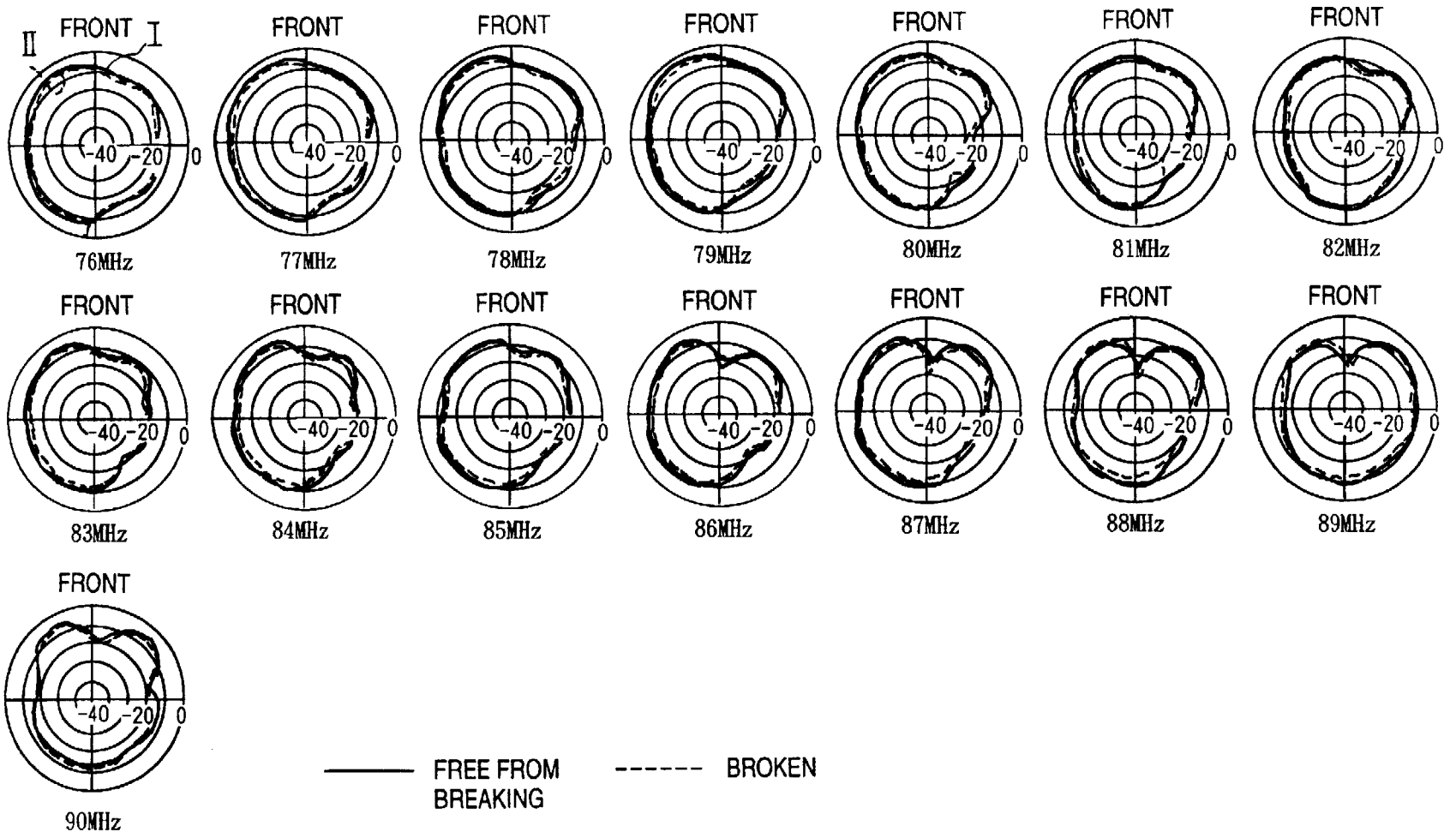
FIG. 56 is a graph for comparing the performances obtained when the right glass antenna is and is not arranged in the second embodiment.

FIG. 55 shows the reception sensitivity characteristics (solid curve) obtained when horizontally polarized FM radio waves (76 MHz to 90 MHz) are received by the antenna system of the second embodiment, and the reception sensitivity characteristics (broken curve) obtained when the horizontally polarized FM radio waves are received by the antenna system of the first embodiment. FIG. 56 shows the directivity characteristics (solid curve) obtained when the FM radio waves are received by the antenna system of the second embodiment, and the directivity characteristics (broken curve) obtained when the FM radio waves are received by the antenna system of the first embodiment.

FIGS. 54 and 55 reveal that the open stub structure of the second embodiment can provide FM reception performance free from the influence of the AM antenna line since it allows to ignore the influence of the antenna line 31 on the right glass. This fact also suggests that in the antenna system having an open stub structure of the second embodiment, the antenna line arranged on the right glass may, of course, be the antenna line as shown in FIG. 21, or may be replaced by, e.g., a monopole type antenna line or a loop antenna line. Furthermore, when the open stub structure which can prevent the AM antenna line from influencing the FM reception performance is used, a reception signal of FM radio waves received by the AM antenna line 31 is not supplied to the feeding point 16 via the connection line 14, and for example, a coil for cutting an FM signal, which is required in a conventional system, can be omitted.

AM Reception Performance

Tables below compare the reception sensitivity characteristics for AM radio waves of the antenna system of the second embodiment (also, the antenna system of the first embodiment) with those of a conventional pillar antenna. Especially, Tables 1 and 2 show examples using AV lines as the connection line 14, and Table 3 summarizes the AM reception sensitivity obtained when the type of the connection line is variously changed.

Table 1 summarizes data for the antenna systems of the first and second embodiments constituted using a 75-W 1.5C cable between the antenna and tuner.

TABLE 1

| Using 1.5C Cable | 666 kHz | 1,035 kHz | 1,458 kHz |
|---|---|---|---|
| Pillar Antenna | 15.0 dB | 62.6 dB | 61.1 dB |
| First Embodiment | 5.8 dB | 52.5 dB | 51.6 dB |
| Second Embodiment | 9.2 dB | 56.6 dB | 55.7 dB |

TABLE 2

| Using Low-capacitance Cable | 666 kHz | 1,035 kHz | 1,458 kHz |
|---|---|---|---|
| First Embodiment | 9.2 dB | 56.2 dB | 55.0 dB |
| Second Embodiment | 9.2 dB | 56.6 dB | 58.5 dB |

As can be seen from the two tables above, the AM antenna line 31 on the right glass surface, which is connected to the antenna line 30 on the left glass surface via the AV line 14 serves to correct the AM sensitivity. In particular, in an example of Table 1 using the 1.5C cable, the sensitivity improves by about 4 dB on average, and in an example of Table 2 using the low-capacitance cable, the sensitivity improves by about 3 dB on average. As can be seen from these tables, the AM antenna line 31 on the right glass greatly contributes to improvement of the AM sensitivity.

TABLE 3

| Changing Line Types | 666 kHz | 1,035 kHz | 1,458 kHz |
|---|---|---|---|
| First Embodiment (Reference) | 0 dB | 0 dB | 0 dB |
| Second Embodiment (Using Coaxial Cable) | 2.0 dB | 1.4 dB | 2.2 dB |

TABLE 3-continued

| Changing Line Types | 666 kHz | 1,035 kHz | 1,458 kHz |
|---|---|---|---|
| Second Embodiment (Using AV Line) | 3.4 dB | 4.1 dB | 4.1 dB |

As can be seen from Table 3, when the AV line is used as the connection line, the sensitivity improves by about 2 dB on average as compared to that obtained when the coaxial cable is used. When the coaxial cable is used, the parasitic capacitance in the cable acts as a reactive capacitance, resulting in a sensitivity loss.

The difference between the conventional glass antenna system of Japanese Laid-Open Patent No. 4-77005 and the glass antenna system of the second embodiment will be described below. In the antenna system of Japanese Laid-Open Patent No. 4-77005, an FM antenna pattern and a phase adjustment conductor element are arranged on the first glass surface of two glasses, and are connected to a feeding point on the first glass surface. On the other hand, on the second glass surface, the same FM reception antenna pattern is formed, and is connected to a feeding point arranged on the second glass surface. These two feeding points are guided outside the glasses via coaxial connection lines, and are connected to each other. More specifically, signals received by the antenna patterns on the two glass surfaces are synthesized, and the synthesized signal is supplied to a tuner.

Therefore, upon comparison between the AM reception antenna system of the second embodiment (especially, the antenna line 30 on the left glass and the antenna line 31 on the right glass for AM reception) and the FM reception antenna system of Japanese Laid-Open Patent No. 4-77005:

(1): Since the antenna line 31 on the right glass in the second embodiment is connected to the antenna line 30 via the connection line 14, and is then connected to the single feeding point 16, the two antenna lines 30 and 31 constitute a series connection system as a whole. On the other hand, in Japanese Laid-Open Patent No. 4-77005, the antenna lines on the two glass surfaces respectively have feeding points. Therefore, the antenna system of Japanese Laid-Open Patent No. 4-77005 is a parallel system as a whole.

(2): Japanese Laid-Open Patent No. 4-77005 characterized by the parallel arrangement requires a coil for cutting broad band components. However, the antenna system of the second embodiment with an open stub structure does not require such coil since the AM antenna line has no influence on FM reception.

(3): In Japanese Laid-Open Patent No. 4-77005 which indispensably uses a coaxial cable, the parasitic capacitance of the coaxial cable acts as a reactive capacitance. However, in the second embodiment of the present invention, which can use an AV line, high sensitivity can be maintained by using an inexpensive AV line with a small parasitic capacitance in place of the coaxial cable.

Noise Reduction

When the antenna line is attached to the side window glass, the following problem is posed: many signal lines run in the side surface of the vehicle body, and may serve as a noise source if the cable of the signal lines is close to the antenna line on the glass surface.

In FIG. 19, as for AM reception, the antenna system of the second embodiment distributes the AM reception sensitivity by extending the AM reception antenna lines on the right and left side window glasses. This layout lowers the reception sensitivity of each of the antenna lines 30 and 31 on the two glass surfaces. Therefore, the AM reception antenna line with low sensitivity can provide the merit of low reception sensitivity to noise.

In particular, since the right and left blinkers of a vehicle rarely operate at the same time, only one of the right and left blinkers blinks at a certain timing. Therefore, in the second embodiment, AM reception signals received on the right and left glass surfaces are synthesized and the reception sensitivity is improved. However, noise components generated by devices such as blinkers which rarely operate at the same time are halved since only one of them operates at a time, resulting in a small absolute amount of noise.

Furthermore, the principle of the second noise reduction method adopted in the second embodiment will be described below.

In FIGS. 20 and 21, the distance between the glass edge and the antenna line 30-3 on the left glass 10L is 30 mm, while the distance between the glass edge and the lowermost portion of each of the antenna lines 31-3, 31-4, and 31-5 on the right glass 10R is 80 mm. More specifically, the distance between the antenna line on the right glass 10R and the noise source is set to be larger than that from the noise source on the left glass. In other words, the reception sensitivity to noise on the right glass relatively lowers. Furthermore, the antenna line 30-3 is arranged on the left glass to extend horizontally rearward, while no AM antenna line extending in the horizontal direction is arranged on the lower portion of the right glass. This layout also contributes to lower the noise reception sensitivity on the right glass.

FIG. 57 is a table showing the comparison results between the prior arts (1 to 3) and the second embodiment which adopts the distributed layout of the AM antenna lines 30 and 31 and the method of separating the antenna line on the right glass from the noise source.

In prior art 1 shown in FIG. 57, when an antenna system was constituted by separating an AM antenna with normal sensitivity from the harness as a noise source, the level of detuned noise received from the harness was 6 dB, and the AM reception sensitivity at that time was 12 dB. If the level of detuned noise is 6 dB, it falls within the allowable range. On the other hand, when the reception sensitivity is 12 dB, no audible problem is posed. However, when the AM antenna line of prior art 1 is arranged adjacent to the harness, an AM reception sensitivity of 12 dB was maintained, but the level of detuned noise rose to 12 dB, resulting in a serious audible problem, as shown in prior art 2 in FIG. 57.

However, in the second embodiment, the low-sensitivity left antenna line 30 (−5 dB) is arranged near the harness (separated by 30 mm from the glass edge, as shown in FIG. 20), and the low-sensitivity right antenna line 31 (−8 dB) is arranged to be largely separated from the harness (by 80 mm from the glass edge, as shown in FIG. 21). For this reason, since the AM reception sensitivity of the left antenna line 30 is 7 dB and the reception sensitivity of the right antenna line 31 is 4 dB, a reception sensitivity of a total of 11 dB is obtained in the entire system, and no practical problem is posed. Since the level of detuned noise received by the left antenna line 30 is 7 dB and the level of detuned noise received by the right antenna line 31 is 0 dB, i.e., a total of 7 dB, this value falls within the allowable range.

Advantage of Second Embodiment

In addition to effects (1) to (3) of the first embodiment, the second embodiment can obtain the following effects:

(4): Since the open stub structure is adopted, the antenna line 31 on the right glass has no influence on the antenna line 20, and a high-performance antenna system can be easily designed.

(5): The antenna lines 31 and 30 arranged on the right and left glass surfaces are connected in series with each other, and consequently, the effect of an increase in glass area is greater than that in the parallel connection method in Japanese Laid-Open Patent No. 4-77005. Therefore, the antenna system of the second embodiment can obtain FM and AM reception sensitivity characteristics equivalent to those of the conventional pillar antenna.

(6): Since the AM antenna lines 31 and 30 extend on the right and left glass surfaces, the reception sensitivity of each antenna line can be lowered. For this reason, the noise reception sensitivity of each antenna line can be lowered.

(7): Since the antenna line 31 on only the right glass is largely separated from the harness, noise reception level can be lowered. In addition, since the antenna line 30 on the left glass 10L extends along the glass edge to have a large length, the function of the AM antenna line can be assured. In other words, noise reduction and high AM sensitivity can be attained at the same time.

(8): Since the lowermost antenna line portion of the antenna line on the right glass 10R is cut, noise from the harness can be reduced. This is because the lowermost antenna line portion can be cut since the antenna line on the right glass serves to assist the antenna line 30 on the left glass in terms of AM reception.

Advantages of the First and Second Embodiments

In addition to effects (1) to (3) above as common effects obtained by the first and second embodiments, the following effects are obtained:

I: When the FM antenna line 20 is doubled, as shown in FIG. 8, even if one antenna line breaks, the reception function can be maintained.

II: When a monopole antenna conductor line extends as an additional line for the AM antenna line extending along the glass edge like the antenna line 30-6 in FIG. 8 or the antenna line 31-4 in FIG. 21, the AM reception sensitivity can be improved.

III: By separating the AM line from the harness, the influence of noise can be eliminated.

<Modification>

Note that a vehicle to which the present invention is to be applied is not limited to vehicles such as a van, wagon, or the like. The present invention can be applied to any other vehicles as long as they have window glasses.

The position of the glass to which the present invention is to be applied is not limited to the side window glass near a rear passenger seat. The present invention can be applied to any other glass surfaces of a vehicle according to its principle. For example, the position of the glass antenna of the first embodiment is not limited to the glass near the rear passenger seat, but may be applied to the glass surfaces near all the seats or to the rear glass surface in some cases. As for the second embodiment, the number of glasses to which the glass antenna of the present invention is applied can be two or more. Combinations of two or more glasses are not particularly limited. For example, the antenna system may be arranged on one right (or left) glass near a front passenger seat and one left (or right) glass near a rear passenger seat. That is, in the second embodiment, the position of the additional antenna line 31 for the low-frequency band (AM) is not particularly limited in principle as long as it is arranged on a glass different from that of the primary antenna line 30 for this frequency band.

The present invention is not limited to the AM and FM receptions. For example, the present invention can be applied to reception of radio waves in two ranges, e.g., high and middle (or low) frequency bands.

The series connection of antenna lines via the AV line according to the second embodiment can be applied to antenna lines extending on three or more glasses in principle.

As many apparently widely different embodiments of the present invention can be made without departing from the spirit and scope thereof, it is to be understood that the invention is not limited to the specific embodiments thereof except as defined in the appended claims.

What is claimed is:

1. A method of designing an antenna on first and second glass surfaces so as to receive a radio wave in a first frequency band and a radio wave in a second frequency band lower than the first frequency band, comprising the steps of:

determining a position of a feeding point and a length of a first antenna line, which extends substantially vertically on the first glass surface and receives the radio wave in the first frequency band;

determining a length and a terminal end position of a second antenna line so as to extend from the feeding point along an upper edge of the first glass surface to receive the radio wave in the second frequency band;

determining a position of a connection point on the second antenna line so that the connection point is remote a predetermined length from the feeding point; and determining a length of a third antenna line, which extends on the second glass surface and is connected to the second antenna line at the connection point, so that an impedance between the second and third antenna lines exhibits a high value in the first frequency band.

2. A vehicle glass antenna for receiving a radio wave in a first frequency band and a radio wave in a second frequency band lower than the first frequency band, comprising:

a first antenna line which extends on a first glass arranged on a side portion of the vehicle so as to receive the radio wave in the first frequency band, and has a feeding point on the first glass;

a second antenna line which extends along an edge of the first glass so as to receive the radio wave in the second frequency band, and has one end connected to said first antenna line at a position in the neighborhood of the feeding point;

a third antenna line, which extends on a second glass, arranged on a side surface opposite to the first glass in a right-and-left direction of the vehicle, so as to receive the radio wave in the second frequency band; and a connection line for connecting said second and third antenna lines, one end portion of said connection line being connected to said third antenna line at a predetermined position on the second glass, and the other end portion thereof being connected to said second antenna line at a position, separated from the feeding point, on the first glass.

3. The glass antenna according to claim 2, wherein said first antenna line extends downward from a substantially central position, in a widthwise direction, of the first glass.

4. The glass antenna according to claim 2, wherein said second antenna line is formed in a loop pattern along the edge of the first glass, and is terminated without returning to the feeding point.

5. The glass antenna according to claim 4, wherein said second antenna line has a branch line at an intermediate point.

6. The glass antenna according to claim 2, wherein said third antenna line has an additional line which extends along an upper edge of the second glass substantially horizontally, and at least two additional lines, which extend along an edge of the second glass substantially vertically.

7. The glass antenna according to claim 6, wherein the first and second glasses have a substantially rectangular shape, said second antenna line has an additional line, which extends along a lower edge of the first glass substantially horizontally, said third antenna line has an additional line, which extends along an edge of the second glass in a substantially vertical direction, and a distance between a lower end portion of the second glass and said additional line of said third antenna line is set to be larger than a distance between a lower end portion of the first glass and said additional line of said second antenna line.

8. A vehicle glass antenna for receiving a radio wave in a first frequency band and a radio wave in a second frequency band lower than the first frequency band, comprising:

a first antenna line extending on a first glass of the vehicle to receive the radio wave in the first frequency band and having an effective feeding point arranged on the first glass;

a second antenna line connected to said first antenna line to receive the radio wave in the second frequency band, and extending by a predetermined length along an edge of the first glass;

a third antenna line extending on a second glass different from the first glass to receive the radio wave in the second frequency band; and a connection line connecting said second and third antenna lines, one end portion of said connection line being connected to said third antenna line at a predetermined first connection position on the second glass, and the other end portion thereof being connected to said second antenna line at a predetermined second connection position, separated from the feeding point, on the first glass.

9. The glass antenna according to claim 8, wherein the first glass is arranged on a side portion of the vehicle, and the second glass is arranged on a side surface opposite to the first glass in a right-and-left direction of the vehicle.

10. The glass antenna according to claim 8, wherein the first frequency band is an FM frequency band, and the second frequency band is an AM frequency band.

11. The glass antenna according to claim 8, wherein said first antenna line extends downward from a substantially central position, in a widthwise direction, of the first glass.

12. The glass antenna according to claim 8, wherein said second antenna line is formed in a loop pattern along the edge of the first glass, and is terminated without returning to the feeding point.

13. The glass antenna according to claim 12, wherein said second antenna line has a branch line at an intermediate point.

14. The glass antenna according to claim 8, wherein said third antenna line has an additional line which extends along an upper edge of the second glass substantially horizontally, and at least two additional lines, which extend along an edge of the second glass substantially vertically.

15. The glass antenna according to claim 14, wherein the first and second glasses have a substantially rectangular shape, said second antenna line has an additional line, which extends along a lower edge of the first glass substantially horizontally, said third antenna line has an additional line, which extends along an edge of the second glass in a substantially vertical direction, and a distance between a lower end portion of the second glass and said additional line of said third antenna line is set to be larger than a distance between a lower end portion of the first glass and said additional line of said second antenna line.

* * * * *